US010752408B2

(12) United States Patent
Savenok

(10) Patent No.: US 10,752,408 B2
(45) Date of Patent: Aug. 25, 2020

(54) LOCKING LID AND CONTAINER ASSEMBLY

(71) Applicant: Pavel Savenok, Wheaton, IL (US)

(72) Inventor: Pavel Savenok, Wheaton, IL (US)

( * ) Notice: Subject to any disclaimer, the term of this patent is extended or adjusted under 35 U.S.C. 154(b) by 152 days.

(21) Appl. No.: 15/815,406

(22) Filed: Nov. 16, 2017

(65) Prior Publication Data

US 2018/0079561 A1 Mar. 22, 2018

Related U.S. Application Data

(63) Continuation-in-part of application No. 14/852,411, filed on Sep. 11, 2015, now Pat. No. 10,219,642, and
(Continued)

(51) Int. Cl.
*B65D 43/06* (2006.01)
*B65D 43/26* (2006.01)
(Continued)

(52) U.S. Cl.
CPC ..... *B65D 43/065* (2013.01); *A47G 19/2272* (2013.01); *B65D 43/02* (2013.01); *B65D 43/0212* (2013.01); *B65D 43/26* (2013.01); *B65D 2543/00046* (2013.01); *B65D 2543/00092* (2013.01); *B65D 2543/00296* (2013.01);
(Continued)

(58) Field of Classification Search
CPC .. B65D 43/065; B65D 43/0212; B65D 43/26; B65D 43/02; B65D 2543/00296; B65D 2543/00685; B65D 2543/00638; B65D 2543/00731; B65D 2543/00537; B65D 2543/00092; B65D 2543/00351; B65D 2543/00046; A47G 19/2272
USPC ..... 215/320, 321; 220/789–791, 801; 229/400–405
See application file for complete search history.

(56) References Cited

U.S. PATENT DOCUMENTS 3,080,993 A * 3/1963 Livingstone ..... B65D 43/021 220/305
3,244,308 A * 4/1966 Esposito, Jr. ..... B65D 41/023 215/270
(Continued)

*Primary Examiner* — James N Smalley
(74) *Attorney, Agent, or Firm* — Christopher J. Scott

(57) ABSTRACT

A container assembly maximizes lid-to-container retention or prevents inadvertent removal of a lid from a container, and includes a container and a lid. The container includes an upper rim and a container wall. The container wall includes a seam and a primary indentation. The indentation traverses the seam at an inner container surface in parallel relation to the rim. The lid comprising a rim-receiving groove, a lid wall, and a wall-to-groove resilient portion. The resilient portion extends intermediate the lid wall and the rim-receiving groove and is resiliently actuable intermediate a relaxed configuration and an actuated configuration. The resilient portion has at least one indentation-engaging portion. The rim-receiving groove receives the upper container rim, and the indentation-engaging portion engages indentation when in the actuated configuration. The rim-receiving groove and the indentation-engaging portion together lock the container lid to the container when in the actuated configuration for cooperatively maximizing lid-to-container retention.

15 Claims, 28 Drawing Sheets

Related U.S. Application Data a continuation-in-part of application No. 29/569,201, filed on Jun. 24, 2016, now abandoned, and a continuation-in-part of application No. 29/585,055, filed on Nov. 19, 2016, now Pat. No. Des. 867,134, and a continuation-in-part of application No. 29/585,057, filed on Nov. 19, 2016, now Pat. No. Des. 850,258, and a continuation-in-part of application No. 29/585,058, filed on Nov. 19, 2016, now Pat. No. Des. 878,917, and a continuation-in-part of application No. 29/585,059, filed on Nov. 19, 2016, now Pat. No. Des. 845,763.

(60) Provisional application No. 62/424,243, filed on Nov. 18, 2016.

(51) Int. Cl.
*A47G 19/22* (2006.01)
*B65D 43/02* (2006.01)

(52) U.S. Cl.
CPC ..... *B65D 2543/00351* (2013.01); *B65D 2543/00537* (2013.01); *B65D 2543/00638* (2013.01); *B65D 2543/00685* (2013.01); *B65D 2543/00731* (2013.01)

(56) References Cited

U.S. PATENT DOCUMENTS

| | | | | |
|---|---|---|---|---|
| 4,027,776 | A * | 6/1977 | Douglas | B65D 43/021 220/281 |
| 4,074,827 | A | 2/1978 | Labe, III | |
| 4,180,179 | A * | 12/1979 | Hoenig | B65D 43/0206 220/783 |
| 5,253,780 | A * | 10/1993 | Adado | A47G 19/2272 220/711 |
| 5,588,552 | A * | 12/1996 | Johnson | B65D 17/165 220/212.5 |
| 5,897,019 | A * | 4/1999 | Stropkay | B65D 21/0222 220/713 |
| 7,357,272 | B2 | 4/2008 | Maxwell | |
| 9,238,529 | B1 | 1/2016 | Newman et al. | |
| 2003/0089713 | A1* | 5/2003 | Belt | B65D 47/265 220/253 |
| 2005/0023183 | A1 | 2/2005 | Banik et al. | |
| 2006/0180028 | A1 | 8/2006 | Burchard | |
| 2008/0011762 | A1 | 1/2008 | Boone | |
| 2008/0047965 | A1* | 2/2008 | Gu | B65D 51/1694 220/634 |
| 2009/0218351 | A1* | 9/2009 | Antal, Sr. | B65D 51/18 220/367.1 |
| 2011/0068105 | A1 | 3/2011 | Pohlman et al. | |
| 2014/0238988 | A1* | 8/2014 | Antal, Sr. | B65D 43/0212 220/256.1 |

* cited by examiner

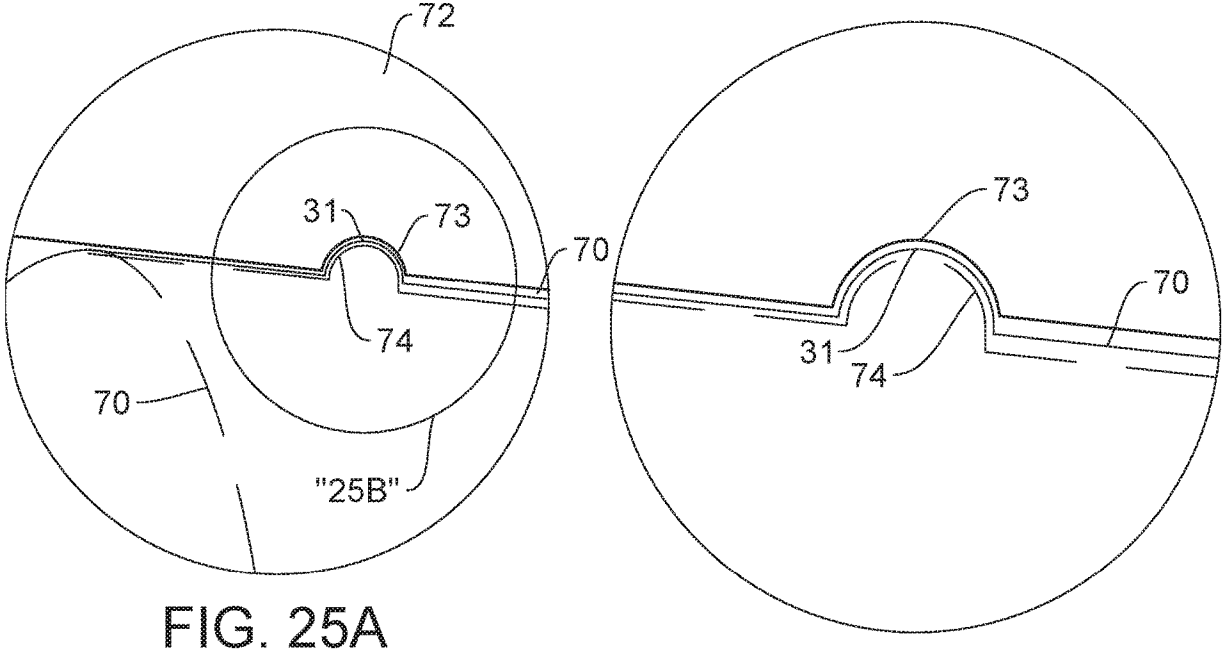
FIG. 25A
FIG. 25B
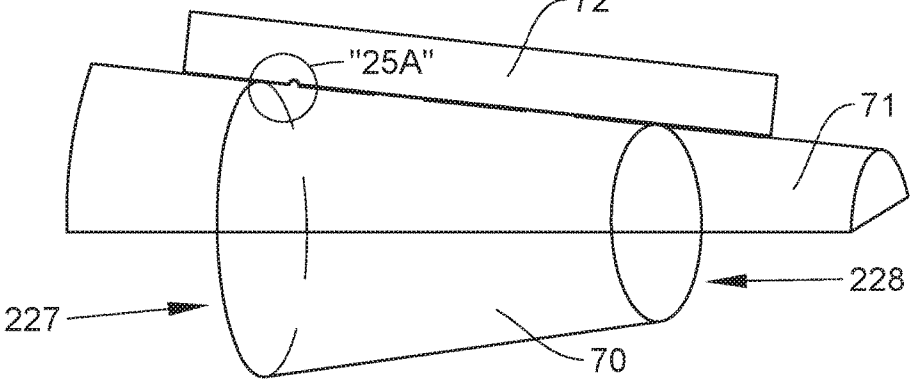
FIG. 25

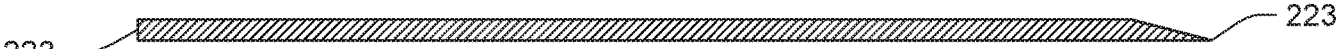
FIG. 34
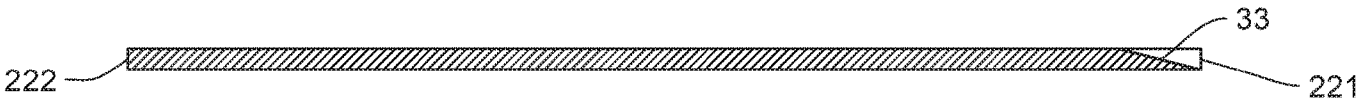
FIG. 33
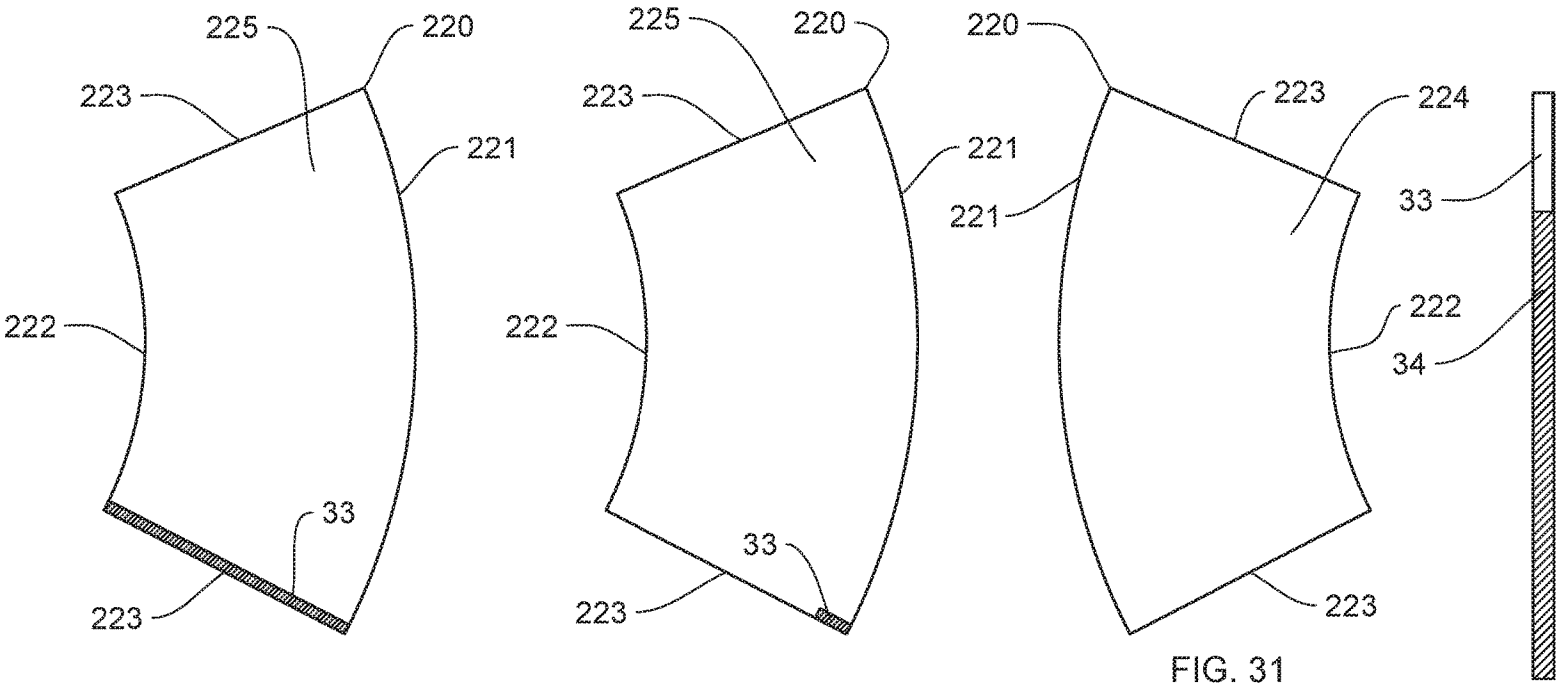
FIG. 29
FIG. 30
FIG. 31
FIG. 32

LOCKING LID AND CONTAINER ASSEMBLY

PRIOR HISTORY

This application claims the benefit of U.S. Provisional Patent Application No. 62/424,243 filed in the United States Patent and Trademark Office on 18 Nov. 2016; is a Continuation-in-Part patent application of U.S. Utility patent application Ser. No. 14/852,411 filed in the USPTO on 11 Sep. 2015, and U.S. Utility patent application Ser. No. 15/657,121 filed in the USPTO on 22 Jul. 2017; and is structurally related to the ornamental designs made the subject of (i) U.S. Design patent application No. 29/569,201 filed in the USPTO on 24 Jun. 2016, (ii) U.S. Design patent application No. 29/585,055 filed in the USPTO on 19 Nov. 2016, (iii) U.S. Design patent application No. 29/585,057 filed in the USTPO on 19 Nov. 2016, (iv) U.S. Design patent application No. 29/585,058 filed in the USPTO on 19 Nov. 2016, and (v) U.S. Design patent application No. 29/585,059 filed in the USPTO on 19 Nov. 2016, the specifications and drawings of all of which are hereby incorporated by reference thereto so far as practicable and allowable by law.

FIELD OF THE INVENTION

The present invention generally relates to container and lid combinations, and more particularly to container-lid combinations operable to enhance lid-to-container retention or enhance the secured relationship of lids to containers, particularly with regard to drink container and lid combinations.

BRIEF DESCRIPTION OF THE PRIOR ART

U.S. Pat. No. 4,074,827 ('827 Patent), issued to Labe, III, discloses a Multi-Purpose Closure for a Container. The closure includes a base member having a central portion and a peripheral flange and a cover member also having a central portion and a peripheral flange. The cover member is adapted to be releasably secured to the base member such that when secured a cavity is formed between the respective members. The cavity is adapted for holding products, e.g., premiums or advertising material therein.

Alternatively, a game or amusement device can be disposed within the cavity. To that end, in one embodiment of the invention the base member includes at least one recess and at least one ball adapted to fit within the recess to provide a game of skill. Means are provided, such as a cross-cut in the closure to enable a straw to be extended therethrough and into the container with the closure in place. A marginal portion is provided in one embodiment on the flange of the cover member to facilitate the separation of the cover member from the base member.

U.S. Pat. No. 7,357,272 ('272 Patent), issued to Maxwell, discloses a Ventable Container Assembly. The '272 Patent describes a ventable container including a container bottom having an inner cavity. The container bottom further has a side wall that terminates in a container rim, and a selectively detachable lid. The lid includes a central panel and peripheral sealing lip that surrounds the panel.

The peripheral sealing lip has a generally inverted U-shaped cross-section that defines a lid channel adapted to receive the container rim, the lid channel being further adapted to position the lid at a first position wherein sealed engagement of the container is effectuated and at a first position relative to the container rim wherein an air passage from the inner cavity to the container surroundings is provided.

U.S. Pat. No. 9,238,529 ('529 Patent), issued to Newman et al., discloses a Lid for a Drink Cup. The '529 Patent describes a lid for a drink cup having a cover, and a slider, the slider engaged in sliding motion on the top of a disc of the cover. The disc has an aperture spaced apart from a flap. The slider is able to move to a position covering the aperture so as to prevent liquid from exiting the drink cup and, the slider is also able to move to a position to uncover the aperture to allow liquid to exit the drink cup. When the slider is positioned over the flap, the flap is forced to open slightly to allow air to enter the drink cup for venting action.

United States Patent Application Publication No. 2005/0023183, authored by Banik et al., describes a container for containing articles. The container comprises a first section and a second section. The first section is capable of engaging the second section to form a hermetic seal. The first section has a first cavity that is surrounded by a first peripheral wall and a peripheral edge. The first peripheral wall has a first surface that is angled toward the peripheral edge. The second section has a second peripheral wall that is capable of sliding between the first peripheral wall and the edge to form a hermetic seal.

United States Patent Application Publication No. 2006/0180028, authored by Burchard, describes a lid for a beverage container for holding a decoction beverage, preferably a disposable tea container with a base plate and a covering arranged at a distance from the base plate in which case between the base plate and the covering a holding space bounded on the sides by a surrounding side wall is formed. A first opening is provided in the base plate through which a decoction unit holding decoction materials can be guided and a second opening smaller than the first opening being formed in the covering or in the region of the covering through which a section of the decoction unit can be guided, the holding space being of dimensions such as to hold at least part of the decoction unit.

United States Patent Application Publication No. 2008/0011762, authored by Boone, describes a splash-proof cup lid that includes plural barriers disposed on the undersurface of the cup lid. The barriers are strategically positioned and uniquely configured to prevent liquid from sloshing through the drink opening when the cup is in an upright or slightly tilted position and is bumped or jarred. The barriers however, do not prevent the liquid from flowing through the drink opening when the cup is tilted to a drinking position.

United States Patent Application Publication No. 2011/0068105, authored by Pohlman et al., describes a container including a lid adapted to seal with a base. The lid and base rims each have vertical segments that mate upon sealing the container. The mating segments form a vertical seal zone. The vertical seal zone has a width extending across the rim surfaces. One or more vent channels are disposed on either or both rims. Each vent channel extends partially into the vertical seal zone.

When pressure inside the container reaches a critical level, the lid rises and reduces the width of the seal zone, creating a vent point. Pressurized vapors traveling through the vent channel overcome rim-engaging forces at the vent point and pass through the engaged rims. Once pressure is purged, the lid descends and resumes its sealed arrangement with the base. The rims may respectively include horizontally oriented segments that engage each other to from a horizontal seal zone.

SUMMARY OF THE INVENTION

The primary objective of this invention is the provision of a number liquid lid-container combinations for maximizing lid-to-container retention or to prevent lids from becoming inadvertently removed from containers once outfitted thereupon. To achieve this basic objective, the present invention generally provides container lids having a rim-receiving groove, a lid wall, and a resilient portion extending intermediate the rim-receiving groove and the lid wall.

The resilient portion is resiliently actuable intermediate an unlocked configuration and a locked configuration, and further preferably comprises at least one indentation-engaging portion. The rim-receiving groove receives the upper container rim, and the at least one indentation-engaging portion engages the at least one indentation when in the locked configuration. Together, the rim-receiving groove and the at least one indentation-engaging portion lock the container lid to the upper container rim of a liquid container when in the locked configuration for maximizing lid-to-container retention.

The container lids according to the present invention are stackable in a series of identical container lids. The series of identical container lids have a relatively reduced stacked height when in the unlocked configuration as compared to the locked configuration and further have a reduced lid-to-lid contact surface area when in the locked configuration for reducing lid-to-lid adhesion. The user may thus select either the unlocked or locked configurations when packaging container lids according to the present invention depending on the requirements of the user.

The container lids according to the present invention are further usable in combination with a particularly manufactured liquid container according to the present invention. The liquid container preferably comprises or includes an upper container rim and a container wall extending downwardly from the upper container rim. The container wall comprises a seam and at least one indentation at the inner container surface. The seam extends orthogonally relative to the container rim, and the at least one indentation extends outwardly at the inner container surface of the container wall.

The at least one indentation comprises a primary indentation, the primary indentation preferably traverses the seam in parallel relation to the container rim. The primary indentation traverses the seam at the inner container surface such that the seam at the inner container surface bisects the primary indentation in substantially equal half portions. The container wall may further preferably comprise a series of secondary indentations that extend outwardly in inferior adjacency to the upper container rim at the inner surface of the container wall in parallel relation to the container rim and in coplanar relation with the primary indentation.

The rim-receiving groove of the container lids preferably comprises an outer groove wall and an inner groove wall. The wall-to-groove resilient portion is preferably L-shaped and connected to the inner groove wall at a first pivot point. The L-shaped resilient portion comprises a base portion and an upright portion that pivot between the unlocked and locked positions. The base portion extends inwardly from the inner groove wall and the upright portion extends substantially parallel to the inner groove wall when in the unlocked configuration. When in the locked configuration, the base portion is coplanar with the inner groove wall and the upright portion extends inwardly relative to the inner groove wall.

The lid wall may preferably comprise a lid indentation. The lid indentation extends inwardly in superior adjacency to the wall-to-groove resilient portion. The lid indentation is connected to the upright portion at a second pivot point, and provides a resilient structural relief for enhancing movement between the locked and unlocked configuration. The outer groove wall of the rim-receiving groove preferably comprises a groove wall indentation. The groove wall indentation extends inwardly in inferior adjacency to the upper container rim for enhancing fitted engagement therewith.

The container lid is preferably provided as an ensemble and comprises a lower lid construction and an upper lid construction. The upper lid construction is seatable atop the lower lid construction and is movable relative thereto. The lower lid construction comprises a lower lid outlet and the upper lid construction comprises an outlet-covering indentation and an upper lid outlet. The outlet-covering indentation is positionable over the lower lid outlet for selectively preventing liquid egress therefrom.

The lower lid outlet is formed in a lower lid indentation and surrounded in spaced relation by a raised ridge. The outlet-covering indentation is smaller in dimension than the lower lid indentation such that an air pocket extends between the lower lid indentation and the outlet-covering indentation when the outlet-covering indentation covers the lower lid outlet. The air pocket further prevents liquid egress from the lower lid outlet.

The upper lid construction comprises an edge-located step down formation received in an edge-receiving groove formed in the lower lid construction. The step down formation enhances seated engagement between the upper and lower lid constructions. The upper lid construction is peripherally sized so as to form an air space radially and outwardly adjacent the step down formation when received in the edge-receiving groove. The air space reduces friction between the upper and lower lid constructions.

The present invention further contemplates a method of manufacturing a liquid container comprising the steps of providing a cup fan, the cup fan having a top edge, a bottom edge, and opposed side edges, and forming a container sidewall from the cup fan. The container sidewall has an open top end, an open bottom end, an inner cup surface, and outer cup surface, and a longitudinal seam extending from the open top end to the open bottom end at an overlap site of the opposed side edges.

First and second press elements are positioned adjacent the outer and inner cup surfaces, preferably at the seam site. Each of the first and second press elements have a non-planar press surface, which surfaces are matable. The outer and inner cup surfaces are pressed via or between the first and second press elements for forming at least one non-planar singular formation at the inner and outer cup surfaces traversing the seam site. The first press element may preferably comprises a female indentation and the second press element may preferably comprise a male protuberance. The male protuberance is matable with the female indentation for forming an outwardly extending indentation at the inner cup surface.

The cup fan preferably comprises a first side and a second side. The second side may preferably be processed before forming the container sidewall to remove material therefrom adjacent a first of the opposed side edges thereby forming at least one material-removed edge section. The material-removed edge section preferably extends obliquely relative to the first side for reducing a seam thickness at the inner cup surface. The material-removed edge section may extend an entire length of the first of the opposed side edges or may be formed adjacent the top edge.

BRIEF DESCRIPTION OF THE DRAWINGS

Other features and objectives of the subject invention will become more evident from a consideration of the following brief descriptions of patent drawings.

FIG. 25 is a second sequential diagrammatic depiction of the process for forming a seamed container sidewall showing the heated press element with female indentation feature and the cone mold with male protuberance in engagement with the paper cone element for forming the indentation formation on the seamed container sidewall.

FIG. 25A is a first enlarged, fragmentary sectional view as sectioned from FIG. 25 to show in greater detail the structures associated with the process otherwise illustrated in FIG. 25.

FIG. 25B is a second further enlarged, fragmentary sectional view as sectioned from FIG. 25A to show in still greater detail the structures associated with the process otherwise illustrated in FIG. 25A.

FIG. 29 is a plan view of a cup fan or template depicted in flat or two-dimensional geometry with material removed from a non-coated side along the entire edge-seam site prior to processing.

FIG. 30 is a plan view of a cup fan or template depicted in flat or two-dimensional geometry with material removed from a non-coated side along a portion of the edge-seam site prior to processing.

FIG. 31 is a plan view of coated side of a cup fan or template depicted in flat or two-dimensional geometry prior to processing.

FIG. 32 is a side edge view of the cup fan or template depicted in flat or two-dimensional geometry otherwise depicted in FIG. 30.

FIG. 33 is a top edge view of the cup fan or template depicted in flat or two-dimensional geometry otherwise depicted in FIG. 30.

FIG. 34 is a top edge view of the cup fan or template depicted in flat or two-dimensional geometry otherwise depicted in FIG. 29.

DETAILED DESCRIPTION OF THE PREFERRED EMBODIMENTS

Figure 1A:
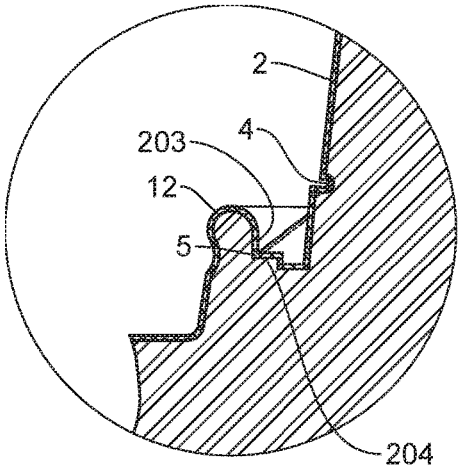
FIG. 1A is an enlarged, fragmentary sectional view as sectioned from FIG. 1 to show in greater detail a locking mechanism of the upper lid thermoform in an originally thermoformed state.
Figure 1:
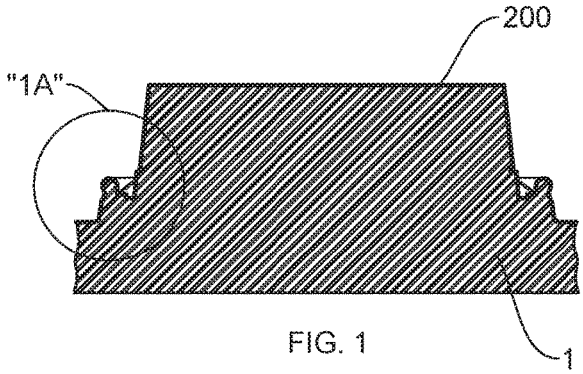
FIG. 1 is a first sequential longitudinal cross-sectional depiction of a generic lid thermoform process according to the present invention depicting a lower mold and an upper thermoformed lid construction embracing the lower mold having mold-based cavities.

Referring now to the drawings with more specificity, the following specifications generally describe a number of lid-container combinations or container assemblies operable for enhancing lid-to-container retention. The prior art perceives a need for a container assembly of low cost construction with unique structural features for preventing inadvertent lid removal from the lower liquid container while further operating to prevent liquid leakage via the junction site of the lid and seam of the lower liquid container. The address these shortcomings in the prior art, the present invention basically provides a container assembly for maximizing lid-to-container retention.

The container assembly according to the present invention preferably comprises a liquid container as at 100 or 110 and a container lid as at 200 or 210. Certain methods for forming the liquid container(s) 100 and 110 and container lids 200 and 210 are also contemplated. FIGS. 1-3A together depict a series of sequential steps for forming the container lids 200 and 210 wherein the lids are formed via a thermoform process. A lower mold 1 and an upper thermoformed lid 200 is shown in each of FIGS. 1, 2, and 3 in various states of engagement with the mold 1, which mold 1 comprises mold-based cavities for forming certain features of the container lid 200. FIG. 1A is an enlarged, fragmentary sectional view as sectioned from FIG. 1 to show in greater detail a locking mechanism of the upper lid thermoform in an originally thermoformed state. This is the unlocked or relaxed lid configuration.

Figure 2A:
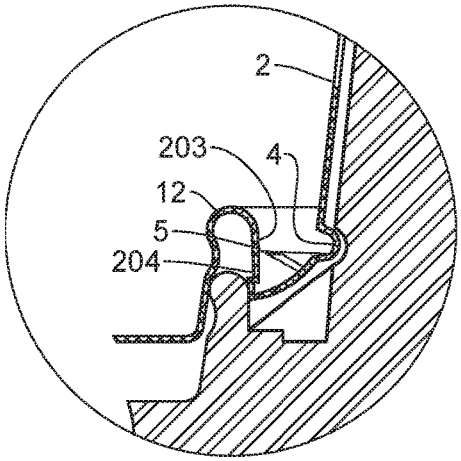
FIG. 2A is an enlarged, fragmentary sectional view as sectioned from FIG. 2 to show in greater detail the upper lid construction being removed from the mold at the mold-based cavity site.
Figure 2:
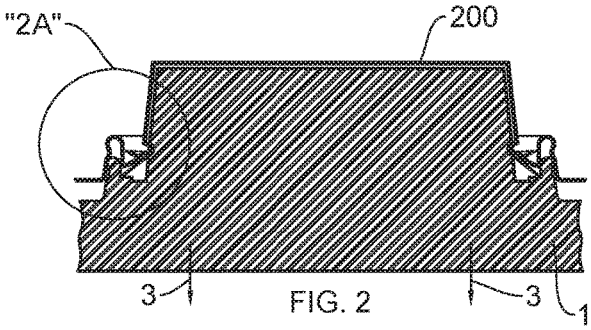
FIG. 2 is a second sequential longitudinal cross-sectional depiction of the lower mold being removed from the upper lid construction.

The reader is directed to points 4 and 5 of the container lid 200 as shown and referenced in FIG. 1A. Point 5 is a pivot point and point 4 is a resilient structural relief. FIG. 2 is a second sequential longitudinal cross-sectional depiction of the lower mold 1 being removed as at arrows 3 from the thermoformed upper container lid 200. Referencing FIG. 2A, the reader will there consider that the resilient locking mechanism of the lid construction 200 has pivoted about pivot point 5 such that a base portion 204 becomes coplanar with an inner groove wall 203 when being reconfigured from the unlocked or relaxed lid configuration into the locked or actuated configuration.

Figure 3A:
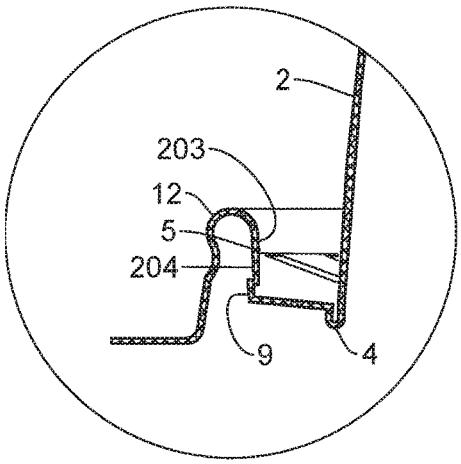
FIG. 3A is an enlarged, fragmentary sectional view as sectioned from FIG. 3 to show in greater detail the locking mechanism of the lid construction in an engaged state after the mold is fully removed from lid construction and after the top of the lid construction is pressed from the top.
Figure 3:
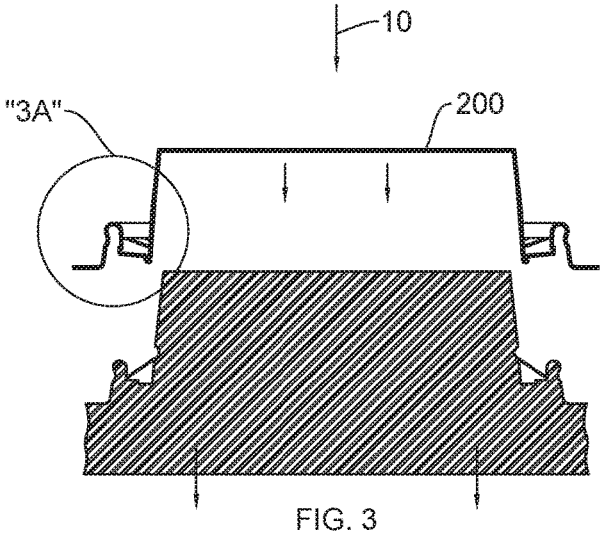
FIG. 3 is a third sequential longitudinal cross-sectional depiction of the lower mold fully removed from the upper thermoformed lid construction, the thermoformed lid construction being depicted in an engaged state.

FIG. 3 is a third sequential longitudinal cross-sectional depiction of the lower mold 1 fully removed from the upper thermoformed container lid or lid construction 200. The thermoformed lid construction 200 is depicted in the locked or actuated state in FIGS. 3 and 3A. The locked or engaged state of the thermoformed lid construction 200 can also be achieved by pressing from the top (as at arrows 10) after the mold 1 is removed from the thermoformed lid construction 200. FIG. 3A shows in greater detail the locking mechanism of the lid construction 200 when in the locked or engaged state after the mold 1 is fully removed from lid construction 200 and after the lid construction 200 is pressed from the top so as to position the lid construction 200 in the locked or actuated configuration.

Figure 4:
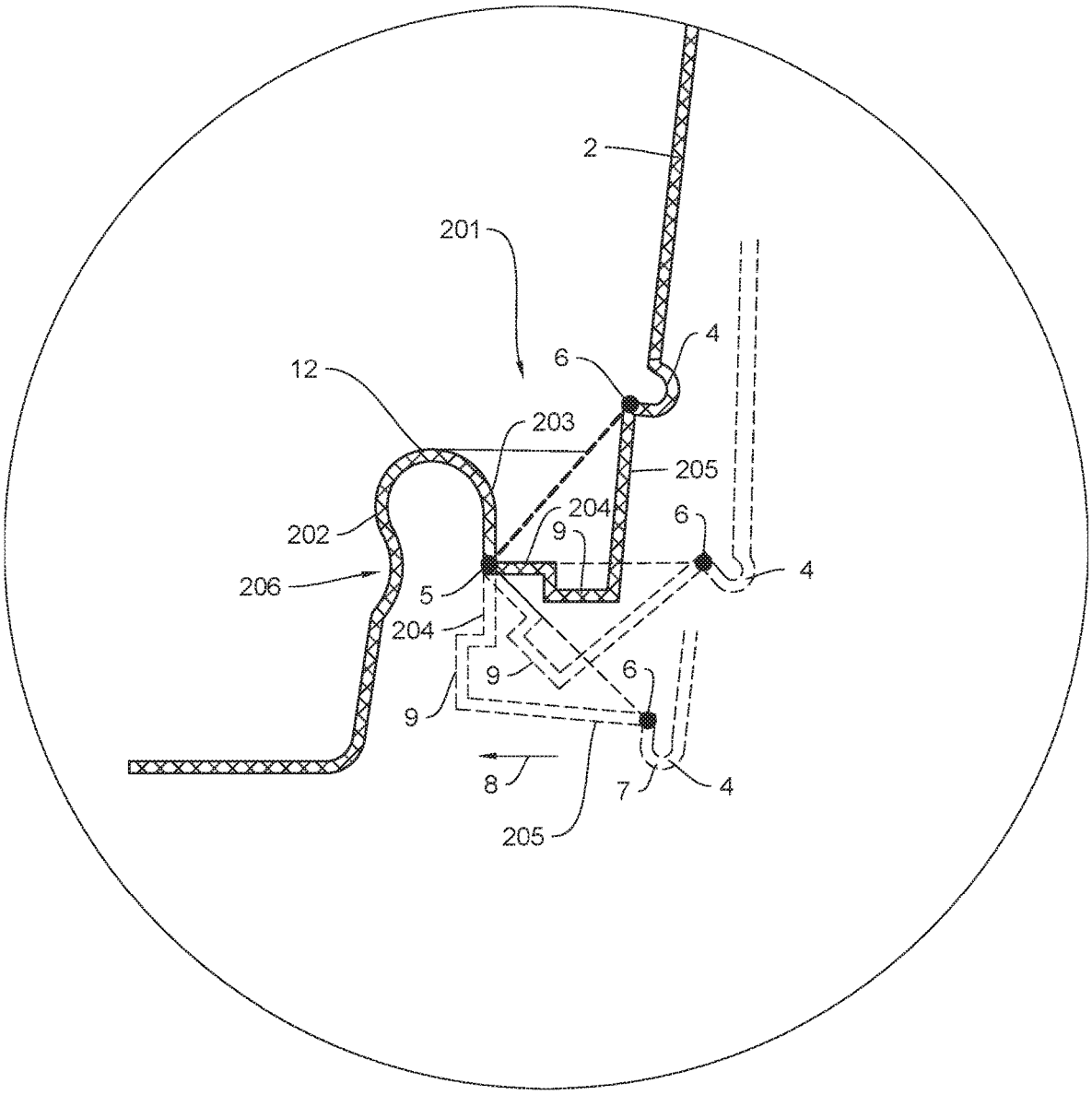
FIG. 4 is a further enlarged, fragmentary sectional view of a first alternative locking mechanism of the lid construction according to the present invention showing the locking mechanism is solid lining at a relaxed, unlocked configuration and showing the locking mechanism in broken lining at an actuated, locked configuration.
Figure 5:
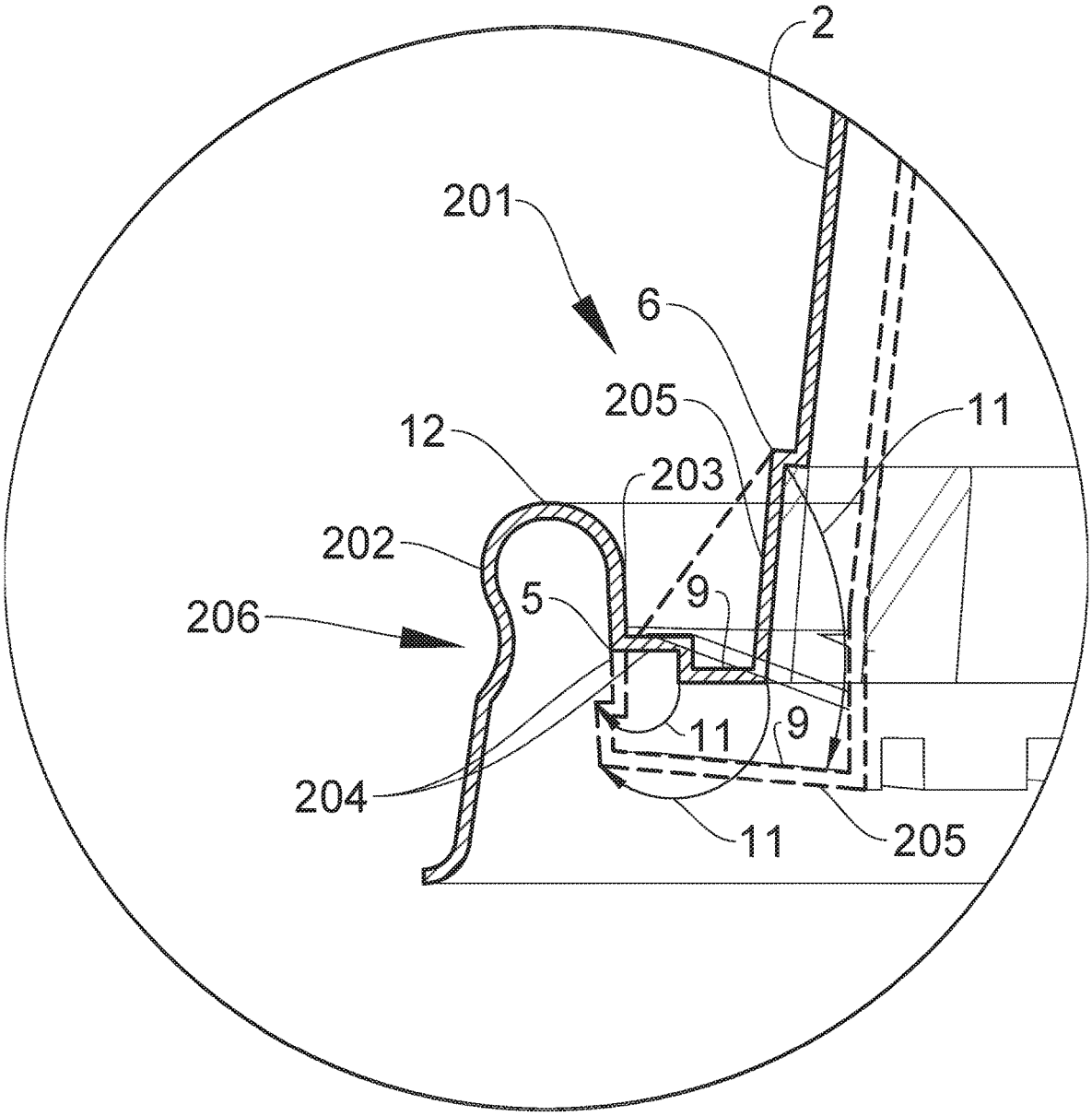
FIG. 5 is a further enlarged, fragmentary sectional view of a second alternative locking mechanism of the lid construction according to the present invention showing the locking mechanism is solid lining at a relaxed, unlocked configuration and showing the locking mechanism in broken lining at an actuated, locked configuration.
Figure 7:
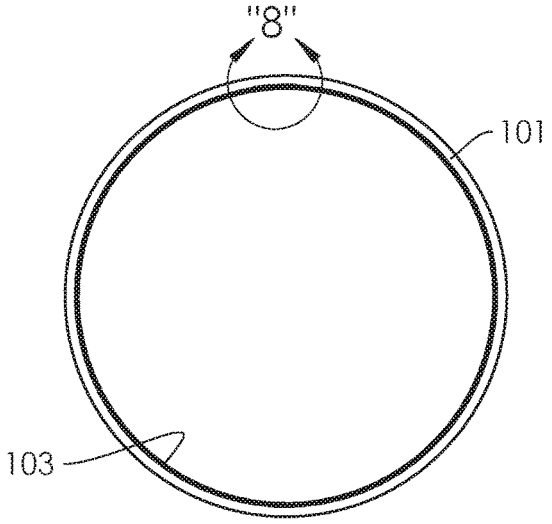
FIG. 7 is a transverse cross-sectional view as sectioned from FIG. 6 through the indentation formation.
Figure 8:
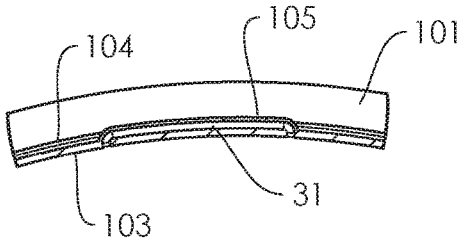
FIG. 8 is an enlarged, fragmentary sectional view as sectioned from FIG. 7 to show in greater detail structure associated with the indentation formation.
Figure 6:
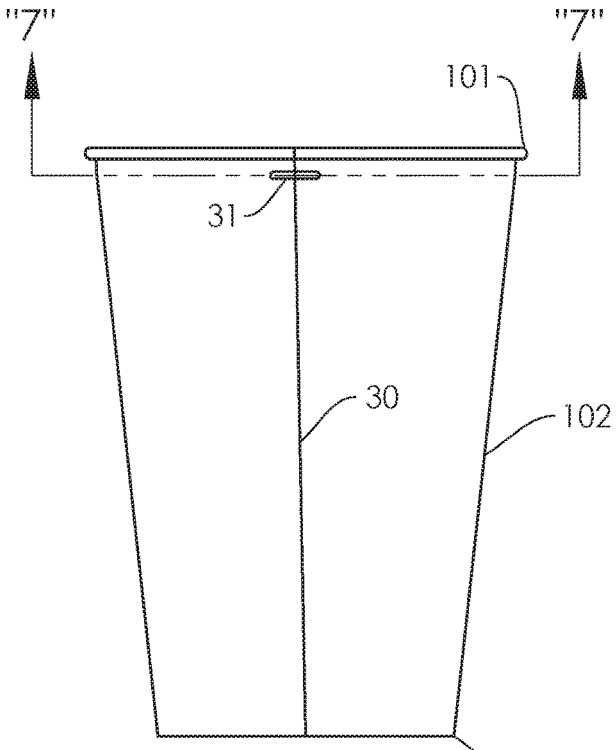
FIG. 6 is a side elevational of a first seamed liquid container according to the present invention showing a seam and an external protuberance associated with an internal indentation formation, which indentation formation traverses the seam.
Figure 9:
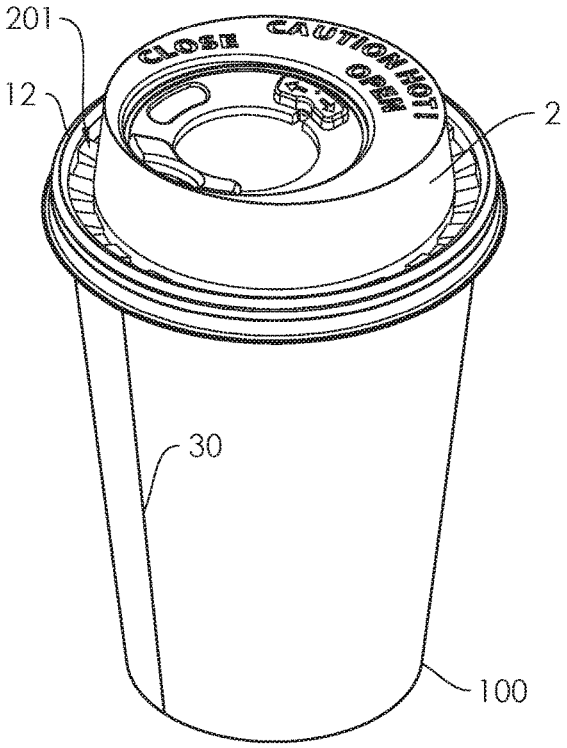
FIG. 9 is a top perspective view of the first seamed liquid container according to the present invention with a reclosable lid construction attached to an upper rim of the first seamed liquid container.
Figure 12:
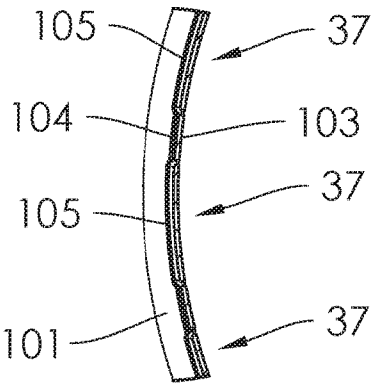
FIG. 12 is an enlarged, fragmentary sectional view as sectioned from FIG. 11 to show in greater detail structures associated with the series of indentation formations.
Figure 11:
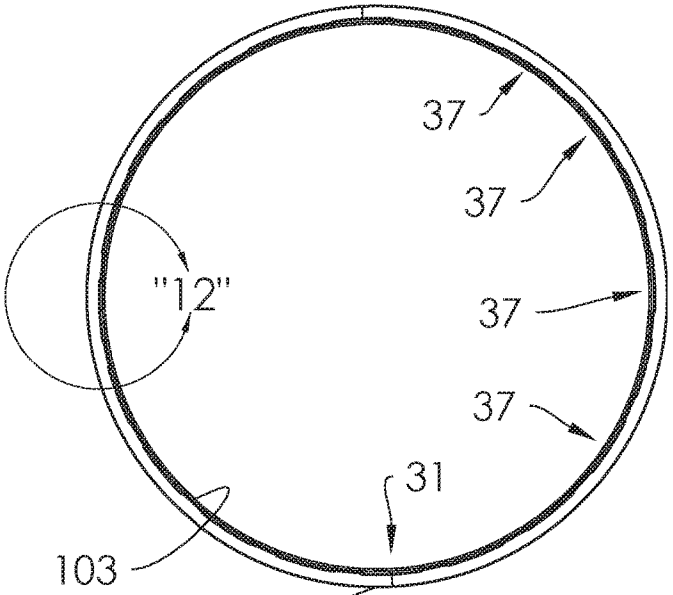
FIG. 11 is a transverse cross-sectional view as sectioned from FIG. 10 through the series of indentation formations.
Figure 10:
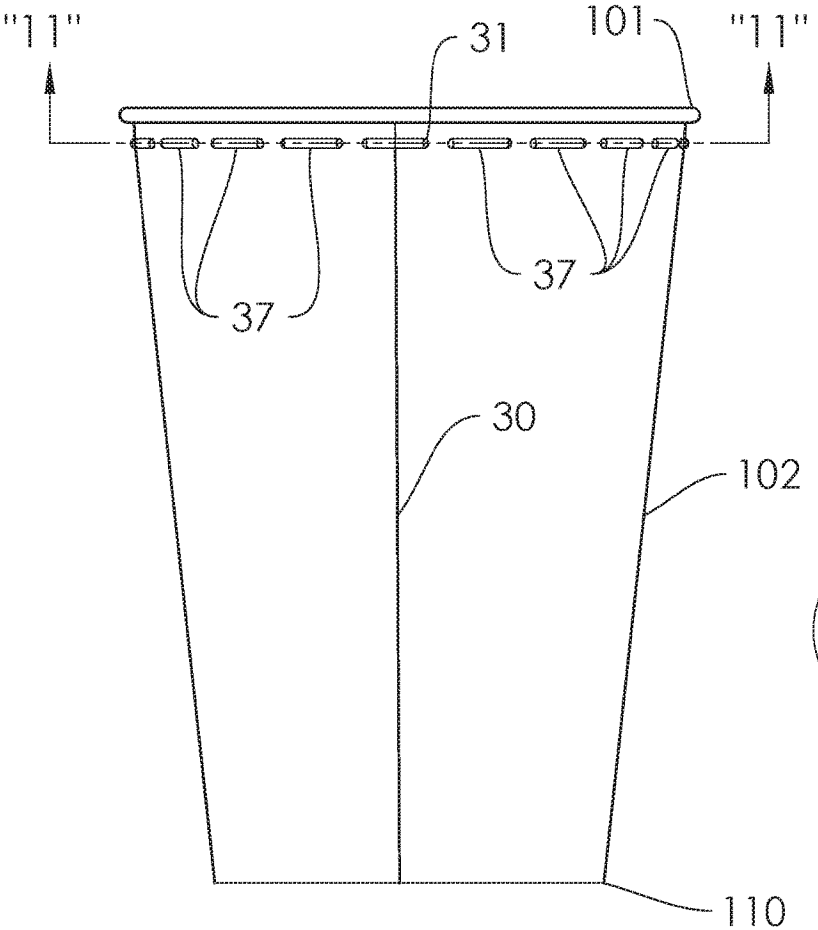
FIG. 10 is an enlarged side elevational view of a second seamed liquid container according to the present invention showing a seam and a series of indentation formations, which series of indentation formations comprise a primary indentation formation traversing the seam and a series of secondary indentation formations radially extending in coplanar relation with the primary indentation formation.

FIGS. 4 and 5 are further enlarged, fragmentary sectional views depicting a process of directing the container lid 200 into an actuated or locked configuration from a relaxed or unlocked configuration after the mold 1 has been removed from the upper thermoformed lid construction 200. When removed from the mold, the resistance at point 4 (or any other point to create moving momentum) creates certain momentum as at arrows 11 with center point 5. The structure at 6 moves more than 90 degrees and locks the thermoformed material in constant internal resistance mode as at 7 creating constant pressure power vector radially and outwardly directed as at 8. The depression or indentation-engaging formation 9, easily formed during a generic thermoforming process, becomes an indentation-engaging portion 9 that may press against a container wall when outfitted thereupon as represented by force vector 8.

FIGS. 6-21 attempt to depict various views showing the locking mechanism according to the lid constructions 200 and 210 of the present invention in engagement with a cup wall or liquid container as at 100 or 110. The reader will consider that the lid constructions 200 and 210 according to the present invention are designed for use in combination with a low cost, disposable paper-based liquid container formed from overlapped cup fan 220 having a seam as at 30. It is noted that the seam site of a paper-based cup or liquid container is one of the weakest points of a liquid container, liquid often seeping or leaking from the lidded liquid container when a seamed upper container rim is outfitted with a rim-receiving groove of most state of the art lid constructions.

The containers 100 and 110 according to the present invention thus each preferably comprise an upper container rim 101 and a container wall 102 extending downwardly from the upper container rim 101. The container wall 102 preferably comprises a seam as at 30 and a primary indentation or formation 31 that extends radially outwardly relative to the plane of the container wall 102. The seam 30 extends longitudinally or orthogonally relative to the container rim 101 and the primary indentation or formation 31 extends (radially) outwardly in inferior adjacency to the upper container rim 101 at an inner surface 103 of the container wall 102 with a corresponding protuberance 105 at the outer surface 104 of the container wall 102.

The primary indentation or formation 31 preferably traverses the seam 30 in parallel relation to the container rim 101. Container 100 differs from container 110 by having a single indentation identified as a primary indentation or formation 31 whereas container 110 has both a primary indentation or formation 31 and a series of secondary indentations or formations 37 that extend radially outwardly in inferior adjacency to the upper container rim 101 at the inner surface 103 of the container wall 102 in parallel relation to the container rim 101 and in coplanar relation with the primary indentation 31.

Figure 20:
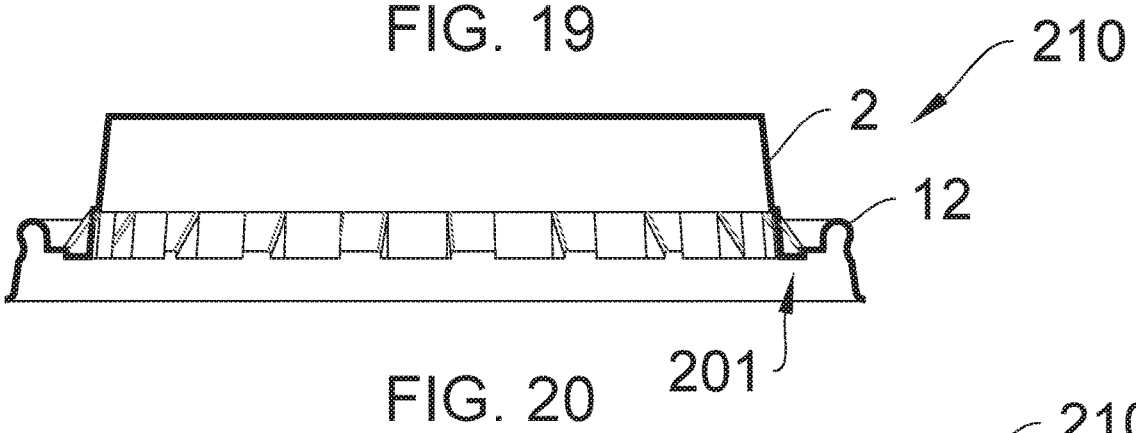
FIG. 20 is a longitudinal cross-sectional view of the first alternative lid construction according to the present invention showing the lid in a pre-compressed, un-engaged, unlocked configuration.
Figure 21:
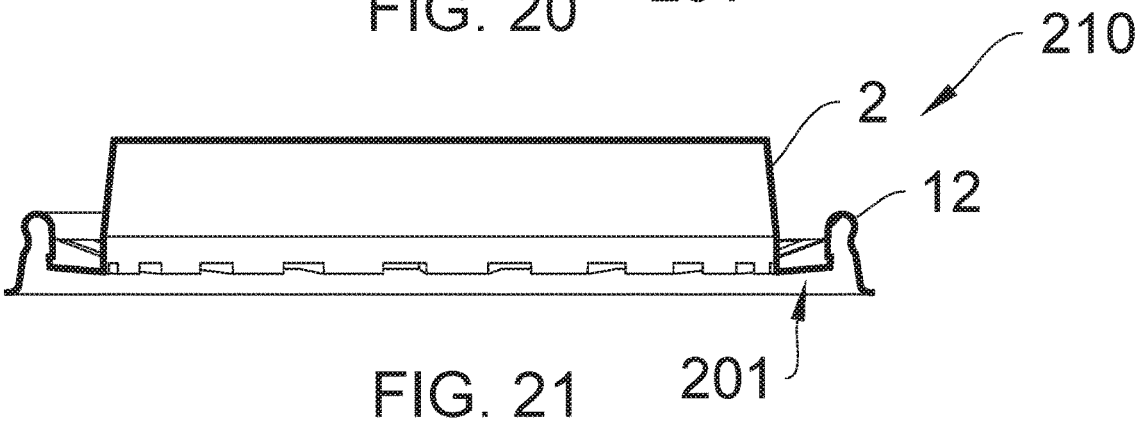
FIG. 21 is a longitudinal cross-sectional view of the first alternative lid construction according to the present invention showing the lid in a compressed, engaged, locked configuration.
Figures 22, 23:
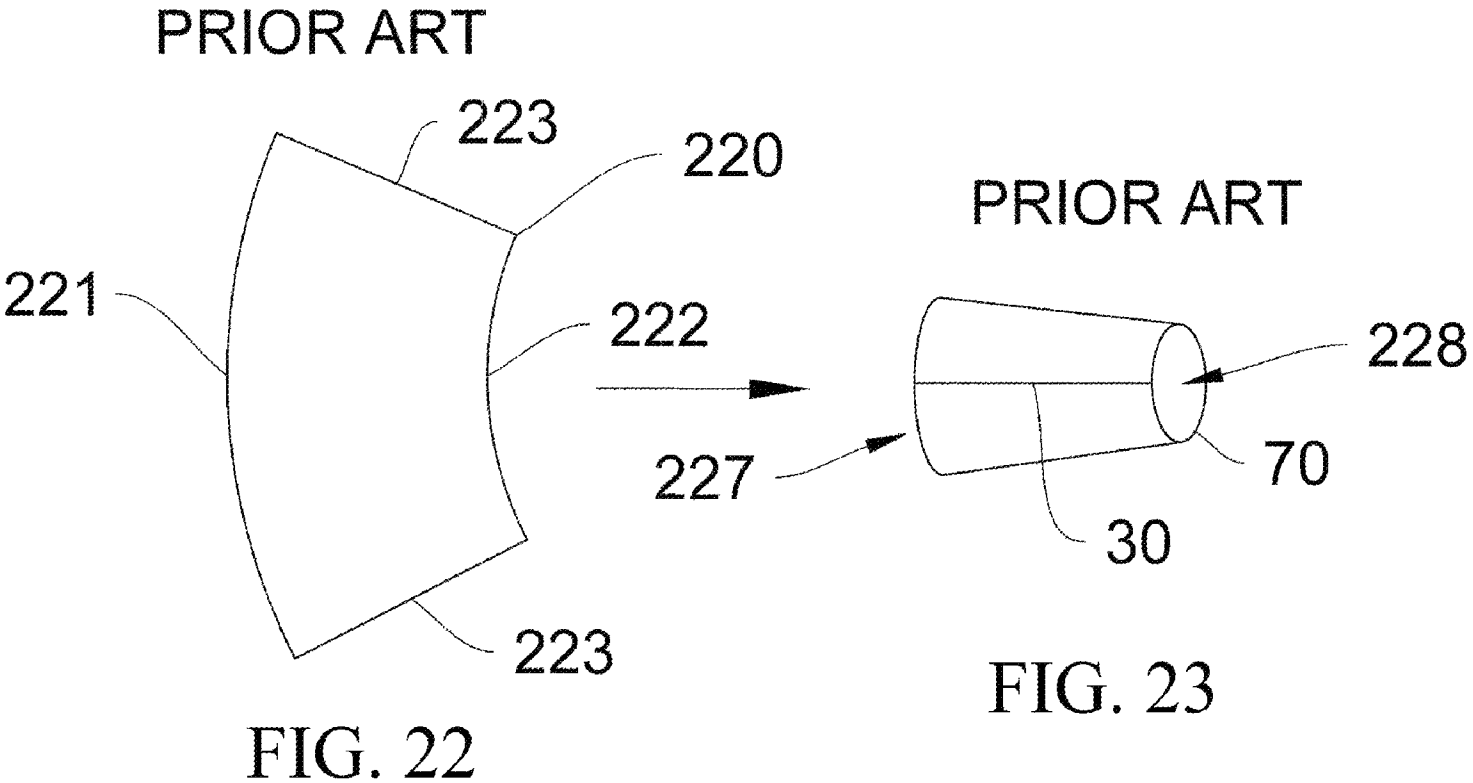
FIG. 22 is a plan depiction of a two-dimensional Prior Art cup fan or template for forming a paper cone element or seamed container sidewall otherwise shown in FIG. 23.
FIG. 23 is a perspective depiction of a three-dimensional Prior Art paper cone element or seamed container sidewall formed from the cup fan or template otherwise shown in FIG. 22.
Figure 24:
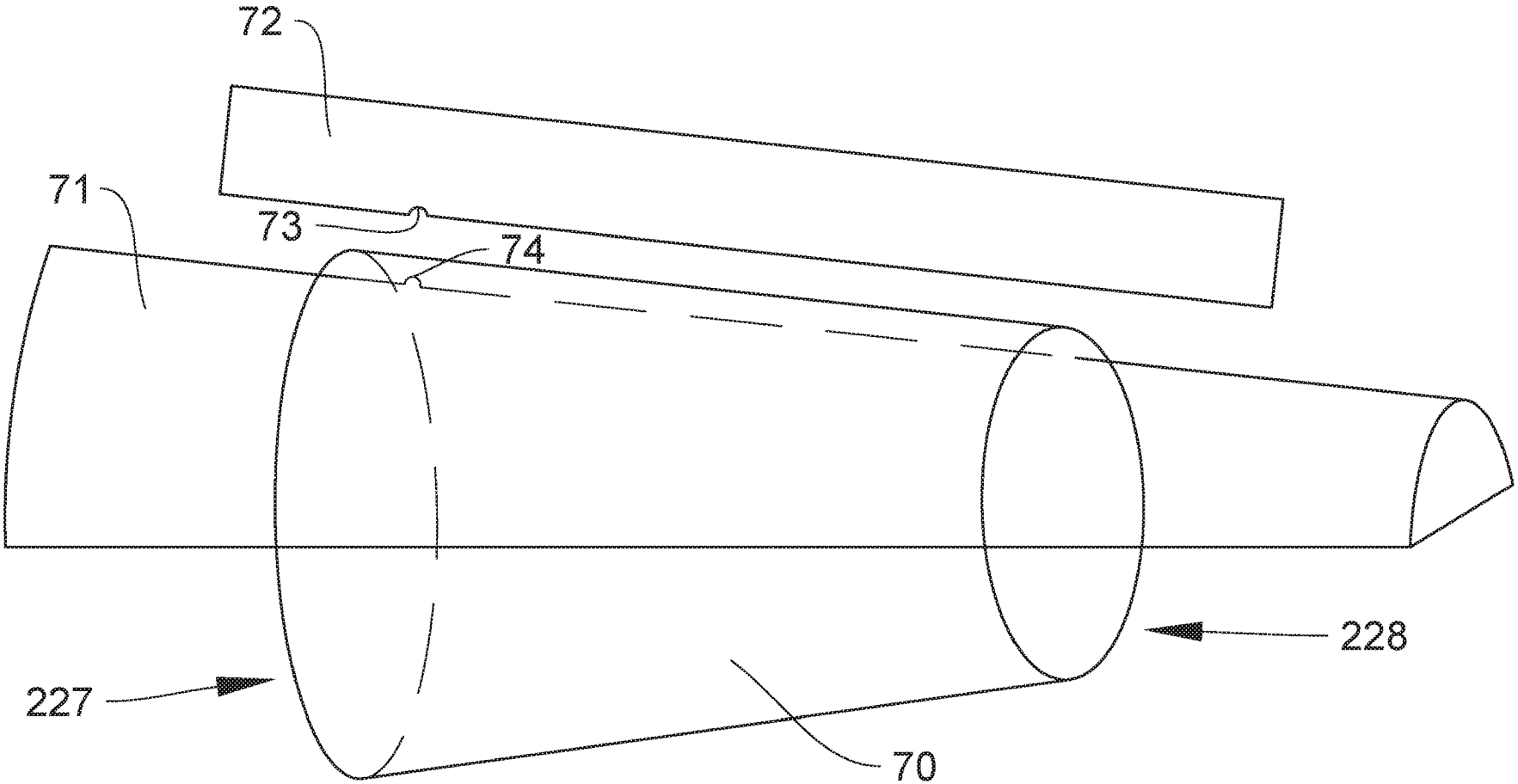
FIG. 24 is a first sequential diagrammatic depiction showing a process for forming a seamed container sidewall showing a heated press element with female indentation feature and a cone mold with male protuberance, the indentation feature and male protuberance being cooperable to form an indentation formation on the seamed container sidewall.
Figure 26A:
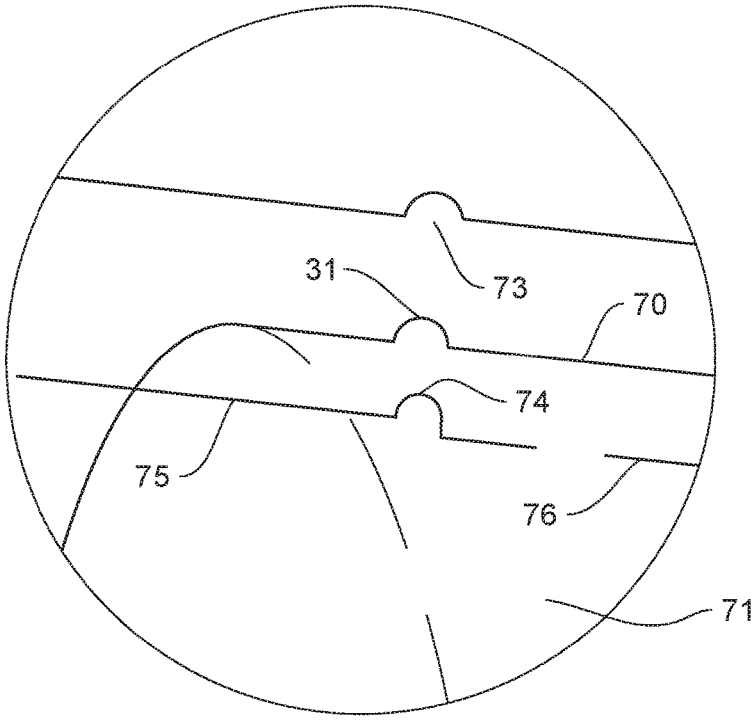
FIG. 26A is an enlarged, fragmentary sectional view as sectioned from FIG. 26 to show in greater detail the structures associated with the process otherwise illustrated in FIG. 26.
Figure 26:
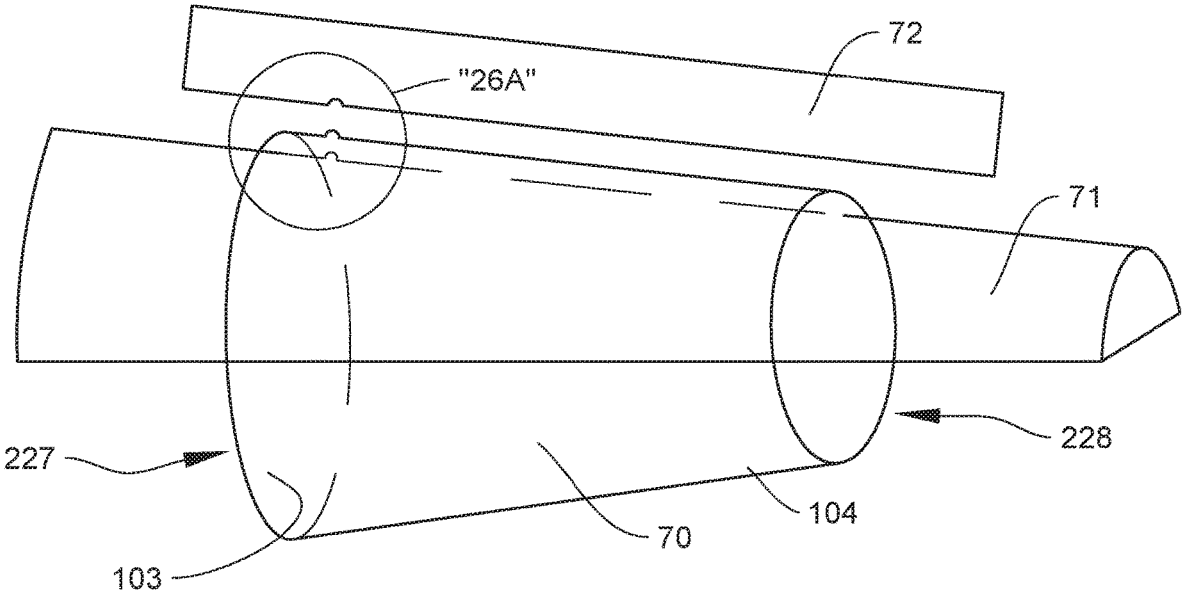
FIG. 26 is a third sequential diagrammatic depiction showing the process for forming a seamed container sidewall showing the heated press element with female indentation feature and cone mold with male protuberance, the indentation feature and male protuberance having cooperated to form the indentation formation on the seamed container sidewall.
Figure 27:
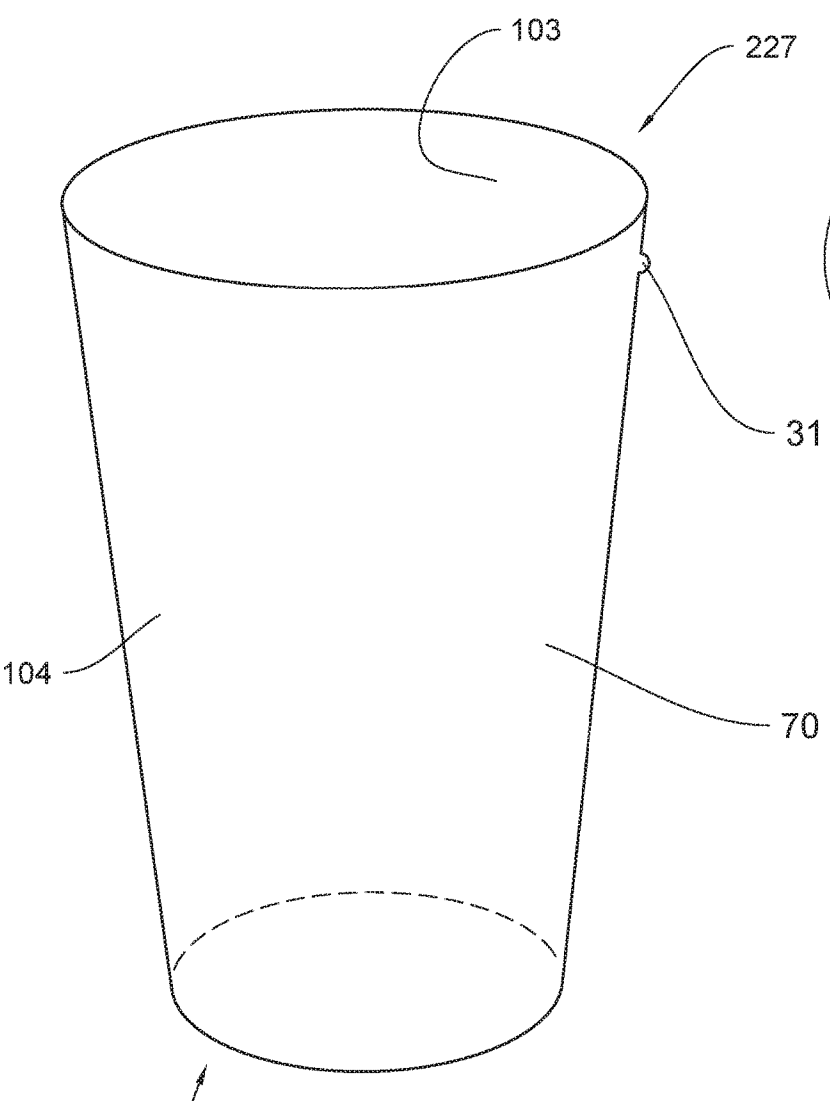
FIG. 27 is a perspective view of a paper cone element outfitted with an indentation formation according to the processes otherwise illustrated/depicted in FIGS. 24-26A.

The container lids 200 and 210 each preferably comprise a rim-receiving groove formation as at 12, an upright lid wall as at 2, and a wall-to-groove locking mechanism or resilient portion as at 201. The wall-to-groove locking mechanism or resilient portion 201 traverses the structural distance between the lid wall 2 and the rim-receiving groove 12 and is resiliently actuable intermediate a relaxed or unlocked configuration generally depicted in solid lining in FIGS. 4 and 5, and an actuated or locked configuration as generally depicted in broken lining in FIGS. 4 and 5. FIG. 20 depicts container lid 210 in an unlocked configuration and FIG. 21 depicts container lid 210 in a locked configuration. The primary difference between container lid 210 and container lid 200 is that the lid 210 is square in form and lid 200 is circular in form.

Central to the practice of the present invention is the wall-to-groove locking mechanism or resilient portion 201. The wall-to-groove resilient portion 201 preferably comprises at least one outer indentation-engaging portion as at 9. The rim-receiving groove formation 12 receives the upper container rim 101 of the containers 100 and 110 and the at least one indentation-engaging portion 9 engages or mates with the primary indentation 31 when directed into the actuated or locked configuration. The rim-receiving groove formation 12 and the at least one outer indentation-engaging portion 9 together function to lock or fasten the container lids 200 and 210 to the containers 100 and 110 when in the actuated or locked configuration for cooperatively maximizing lid-to-container retention or preventing inadvertent removal of the lids 200/210 from the containers 100/110. It is to be understood that the rectangular form of container lid 210 is designed for use with a liquid container having a similarly shaped transverse cross-section although such an embodiment has not been specifically illustrated. The shapes of containers 100 and 110 are believed exemplary and not intended to be limiting.

The rim-receiving groove formation 12 of the container lids preferably comprises an outer groove wall as at 202 and an inner groove wall as at 203. The (wall-to-groove) resilient portion 201 is preferably L-shaped and connected to the inner groove wall 203 at a first pivot point 5. The L-shaped resilient portion 201 preferably comprises a base portion as at 204 and an upright portion as at 205, which upright portion extends orthogonally relative to the base portion 204. The base portion 204 extends inwardly from the inner groove wall 203 and the upright portion 205 extends substantially parallel to the inner groove wall 203 when the container lids 200 and 210 are in the relaxed or unlocked configuration. The base portion 204 becomes coplanar with the inner groove wall 203 and the upright portion 205 extends inwardly relative to the inner groove wall 203 when directed into the actuated or locked configuration.

The lid wall 2 may further preferably comprise a lid wall indentation as at 4. The lid wall indentation 4 extends inwardly in superior adjacency to the wall-to-groove locking mechanism or resilient portion 201. The lid wall indentation 4 is connected to the upright portion 205 at a second pivot point 6. The lid wall indentation 4 provides a resilient structural relief for enhancing movement between the locked and unlocked configurations. The outer groove wall 202 further preferably comprises a groove wall indentation as at 206. The groove wall indentation 206 extends inwardly in inferior adjacency to the upper container rim 101 when outfitted thereupon for enhancing fitted engagement therewith.

Figure 18:
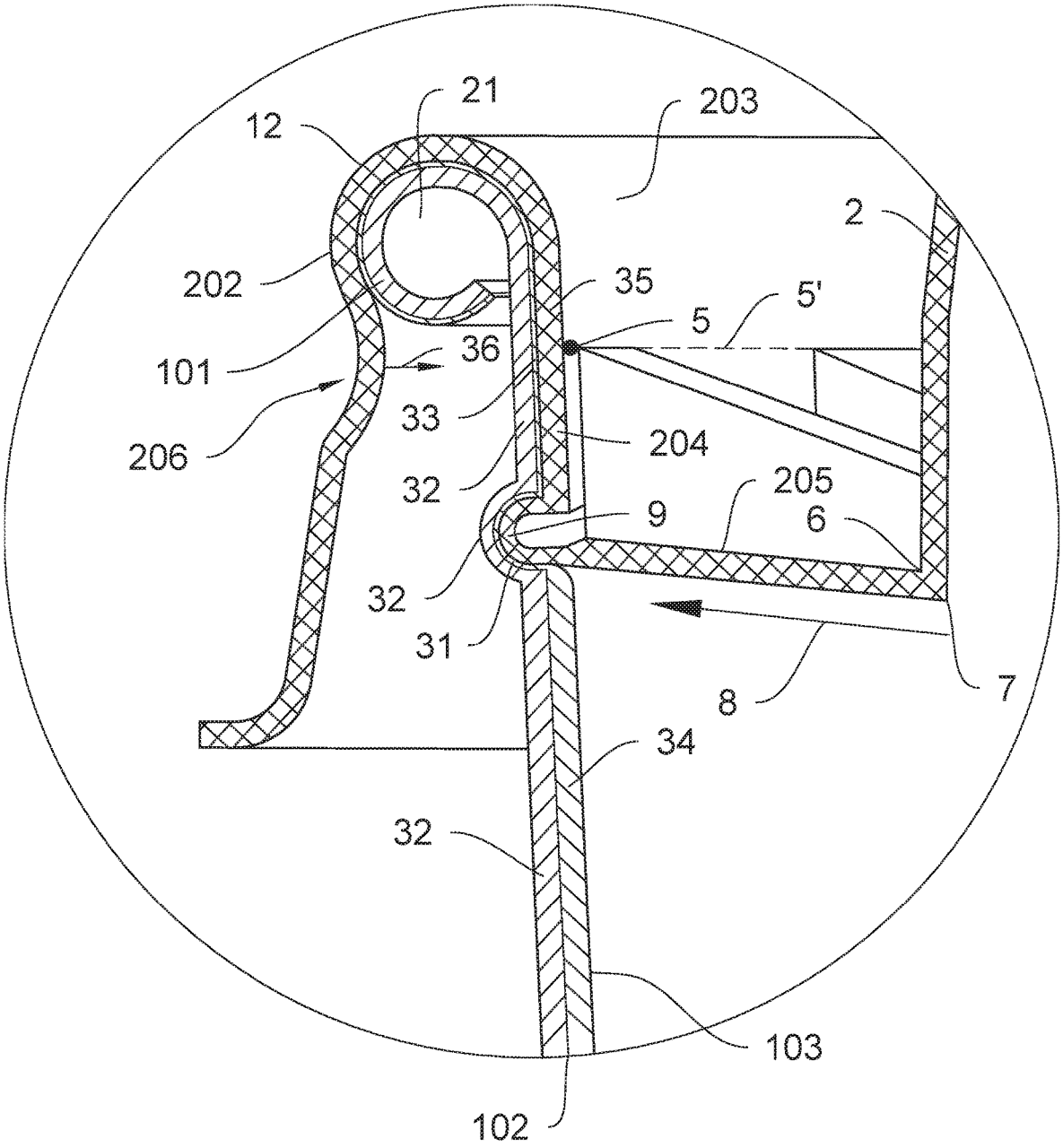
FIG. 18 is an enlarged, fragmentary sectional view as sectioned from FIG. 16 to show in greater detail structures associated with the lid-to-container junction at the indentation site.
Figure 19:
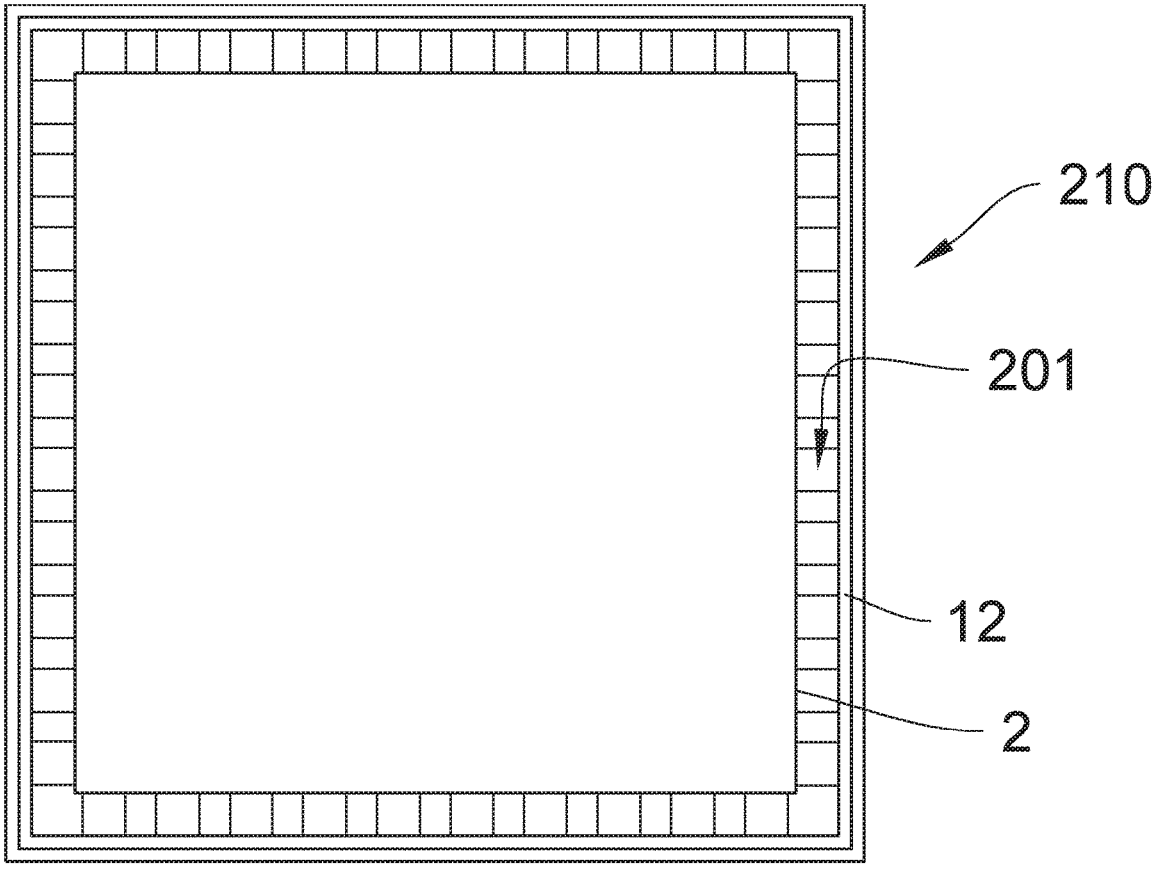
FIG. 19 is a top plan view of a first alternative lid construction according to the present invention showing a rectangular geometrical form for the lid construction outfitted with a locking mechanism according to the present invention.
Figure 36A:
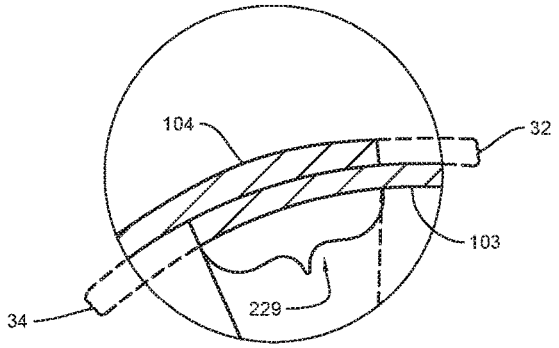
FIG. 36A is an enlarged, fragmentary diagrammatic depiction of the overlap junction creating an inner seam step at inner container surfacing and an outer seam step at outer container surfacing, the inner and outer seam steps having a uniform thickness.
Figure 37A:
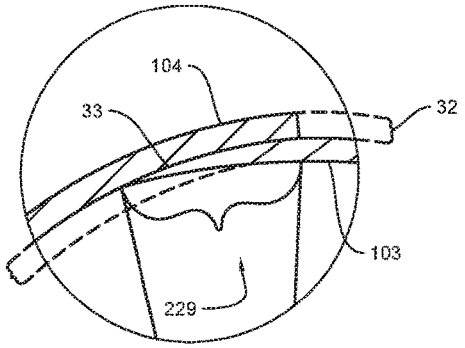
FIG. 37A is an enlarged, fragmentary diagrammatic depiction of the overlap junction creating an inner seam step at inner container surfacing and an outer seam step at outer container surfacing, the inner seam step being reduced in thickness as compared to the thickness of the outer seam step the reduced inner seam step thickness being due to the material-removed edging.
Figure 36:
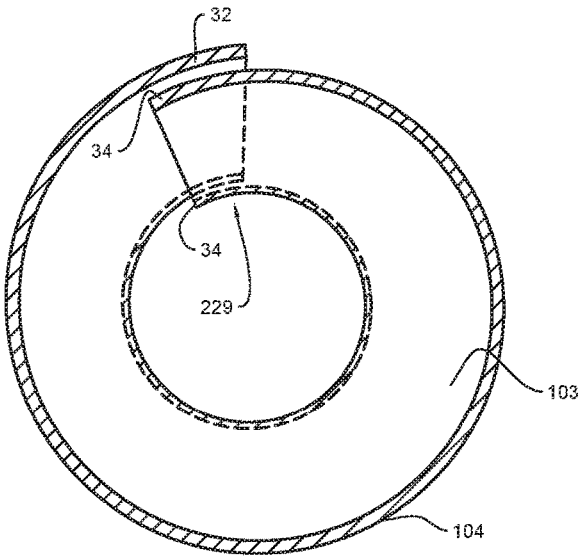
FIG. 36 is a top plan type view of a Prior Art paper cone element without material-removed edging, which edging faces the inner surfacing of the overlap junction site.
Figure 37:
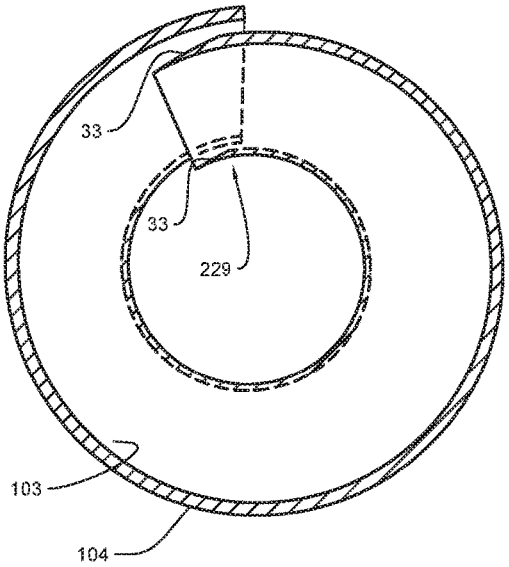
FIG. 37 is a top plan type view of a paper cone element according to the present invention with material-removed edging, which material-removed edging faces the inner surfacing of the overlap junction site.
Figure 35:
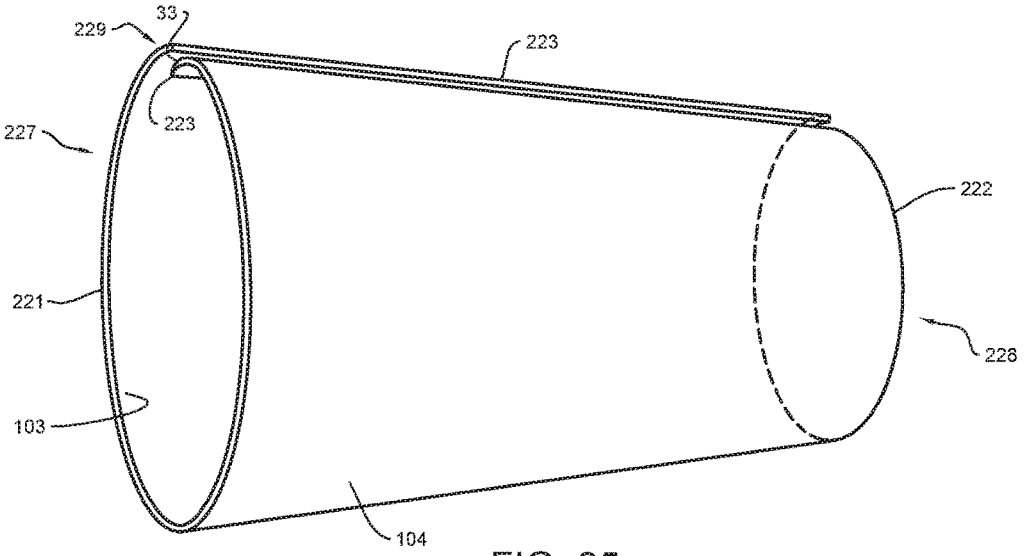
FIG. 35 is a perspective type view of a paper cone element with material-removed edging, which material-removed edging faces the inner surfacing of the overlap junction site.
Figures 38, 39, 40:
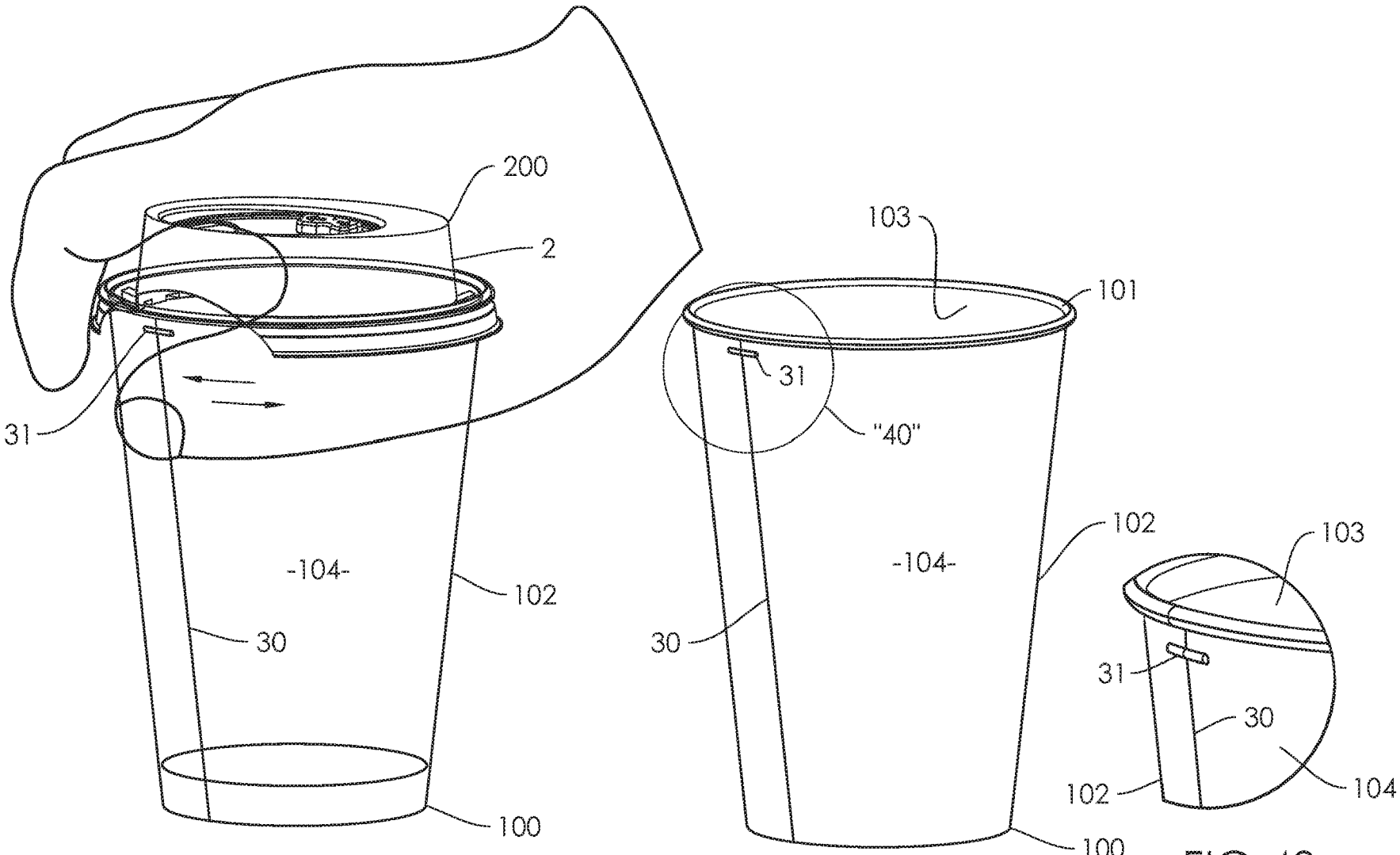
FIG. 38 is a first perspective type diagrammatic depiction of a user's hand rotating a lid construction according to the present invention clockwise or counter-clockwise so that an indentation-engaging portion formed on the lid construction will mate with the primary indentation formed on the container wall.
FIG. 39 is a first perspective view of a seamed liquid container with a primary indentation traversing the seam site.
FIG. 40 is an enlarged, fragmentary sectional view as sectioned from FIG. 39 to show in greater detail the structures associated therewith.
Figure 42:
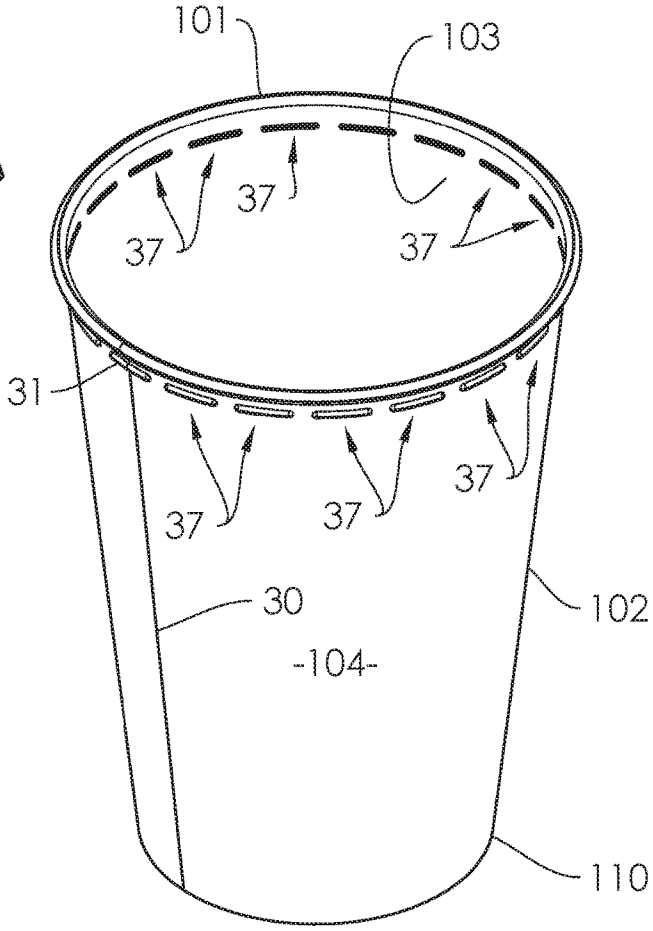
FIG. 42 is a second perspective view of a seamed liquid container with series of circumferentially aligned indentation formations with a primary indentation formation traversing the seam site.
Figure 41:
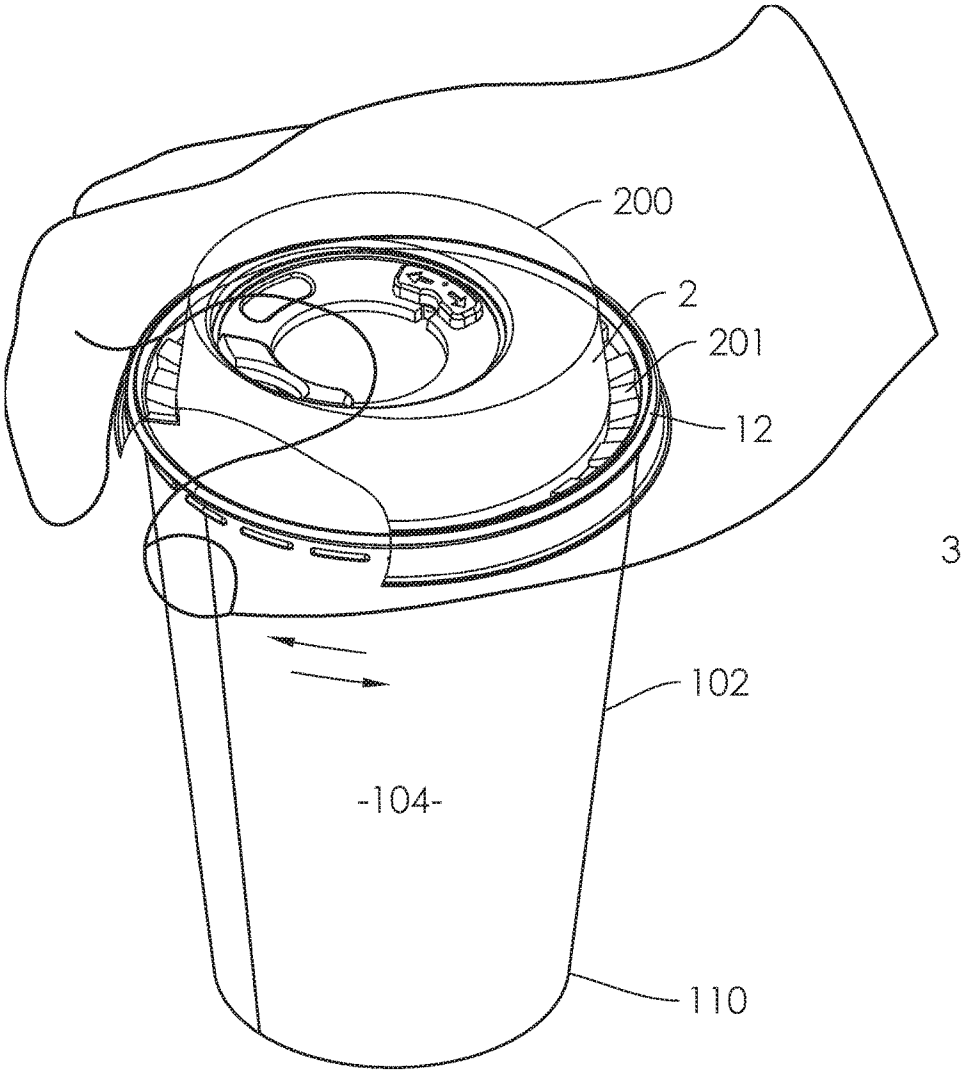
FIG. 41 is a second perspective type diagrammatic depiction of a user's hand rotating a lid construction according to the present invention clockwise or counter-clockwise so that a series of indentation-engaging portions formed on the lid construction will mate with a series of indentation formations formed on the container wall, including a primary indentation formation and a series of secondary indentation formations extending in coplanar relation relative to one another.
Figure 44:
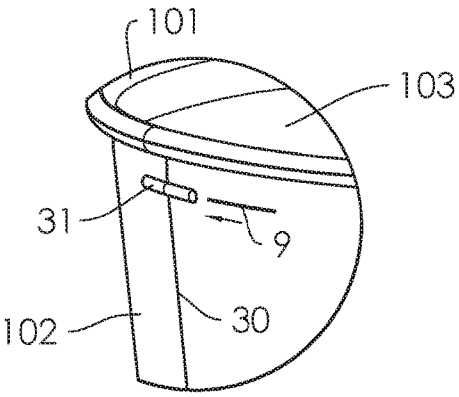
FIG. 44 is an enlarged, fragmentary sectional view showing a seam-traversing primary indention formation and a diagrammatic indentation-engaging formation being directed into positioned receipt within the primary indentation formation.
Figure 43:
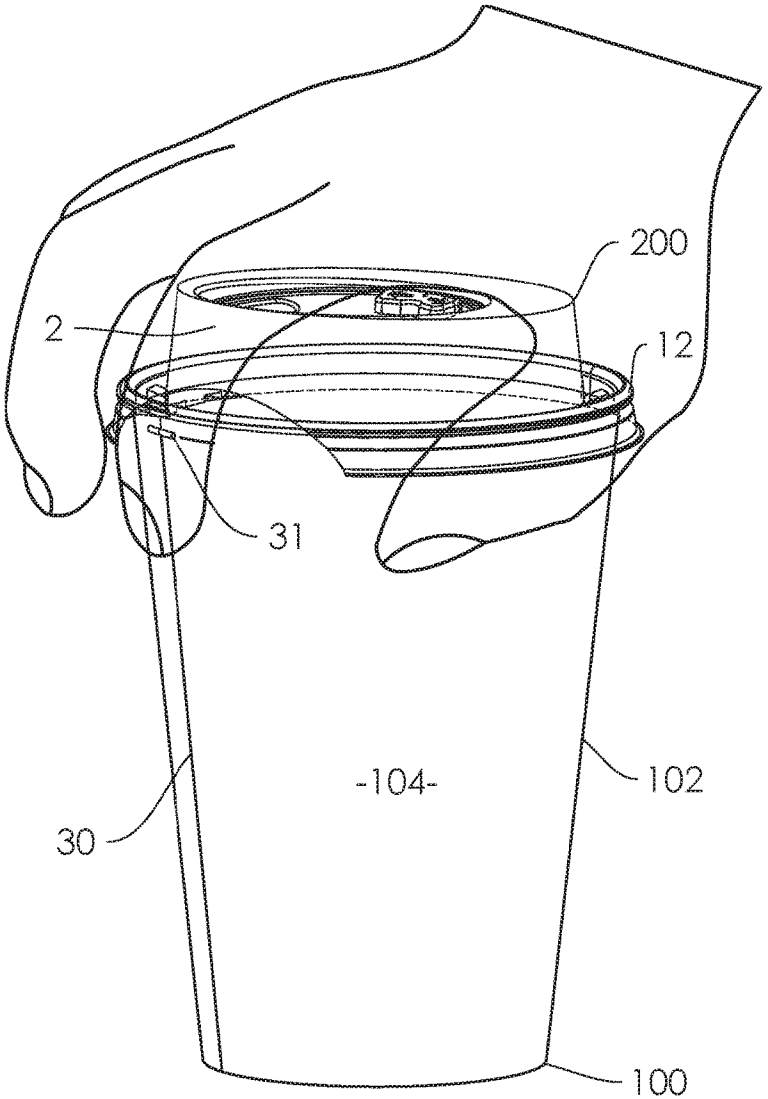
FIG. 43 is a third perspective type diagrammatic depiction of a user's hand rotating a lid construction according to the present invention clockwise so that an indentation-engaging portion formed on the lid construction will mate with the primary indentation formation formed on the container wall.

Referencing FIG. 18, the reader will there note that the upper container rim 101, formed from a lid-engaging ring 21, is coupled to a rim-receiving groove 12 of the lid construction 200. It is important to note that the thickness of the overlapping paper or material construction denoted at 32 at the paper seam above and below the indention formation 31 is the same thickness as the interior layer 34 below the indentation formation 31. The interior paper thickness 33 at and above the indention formation 31 is relatively thinner as compared to the thickness at 34 and 32. See also FIG. 28A where thickness 140 is less than thickness 141. In this regard, the paper thickness has been reduced by either pressing the material or removing material (e.g. shaved/sanded down (from the non-exposed back side to preserve protective layer on of the paper) to limit size of the step in order to create smoother surface at the interior line of the paper seam joint as generally and comparatively depicted in FIG. 36A (depicting an unprocessed material thickness) versus FIG. 37A (depicting a processed material thickness).

The back side 35 as at inner groove wall 203 of the rim-receiving groove 12 of the lid construction 200 tightly or snugly engages surface of the interior layer 33 above the indention formation 31. The same tight or snug engagement occurs at the indention formation 31 at the indentation-engaging portion 9 under constant pressure as at force vector 8. FIG. 18 further depicts in greater detail a pivot point 5, where reference 5' is a plane extending through space and defined by a multitude of pivot points 5 formed circumferentially about the periphery of the lid construction 200. Internal resistance point 7 and moving point 6 are further referenced and depict the lid construction 200 in an engaged configuration. Vector arrow 36 depicts pressure directed radially inwardly at the side of a radial indention 206 formed in the outer groove wall 202 of the rim-receiving groove 12.

Figure 45:
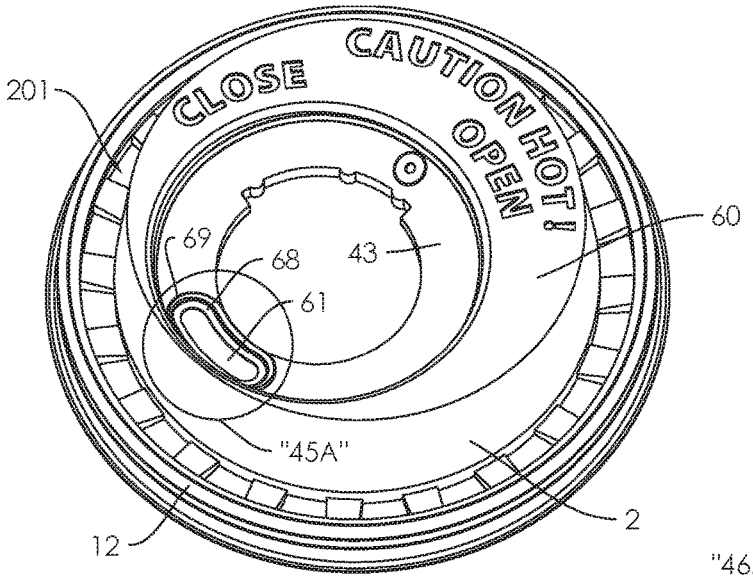
FIG. 45 is a top perspective view of a first alternative lid body or lower lid construction according to the present invention cooperable with the alternative disc body or upper lid construction otherwise depicted in FIG. 46.
Figure 46:
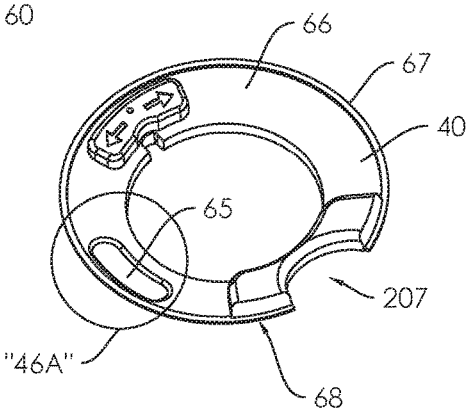
FIG. 46 is a top perspective view of a first alternative disk body or upper lid construction according to the present invention cooperable with the alternative lid body or lower lid construction according to the present invention and otherwise depicted in FIG. 45.
Figure 45A:
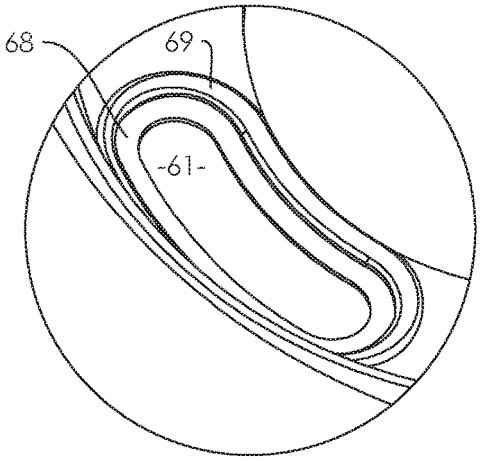
FIG. 45A is an enlarged, fragmentary sectional depiction of a liquid outlet formed in the lower lid construction as enlarged and sectioned from FIG. 45 to depict in greater detail the liquid outlet characterized by being formed in a lower lid indentation and surrounded by a raised ridge.
Figure 46A:
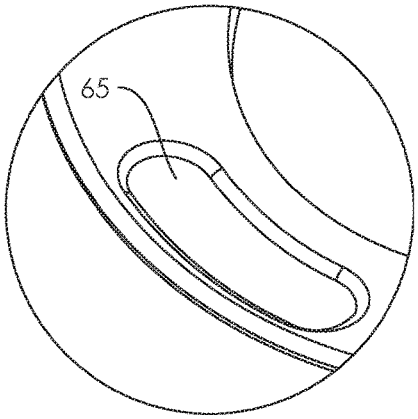
FIG. 46A is an enlarged, fragmentary sectional depiction of an outlet-covering indentation formed in the upper lid construction as enlarged and sectioned from FIG. 46 to depict in greater detail the outlet-covering indentation characterized by having a planar portion greater in area than the liquid outlet for covering the same with a periphery of a reduced dimension relative to the raised ridge so as to form a circumferential air pocket between the raised ridge and the outlet-covering indentation.
Figure 49:
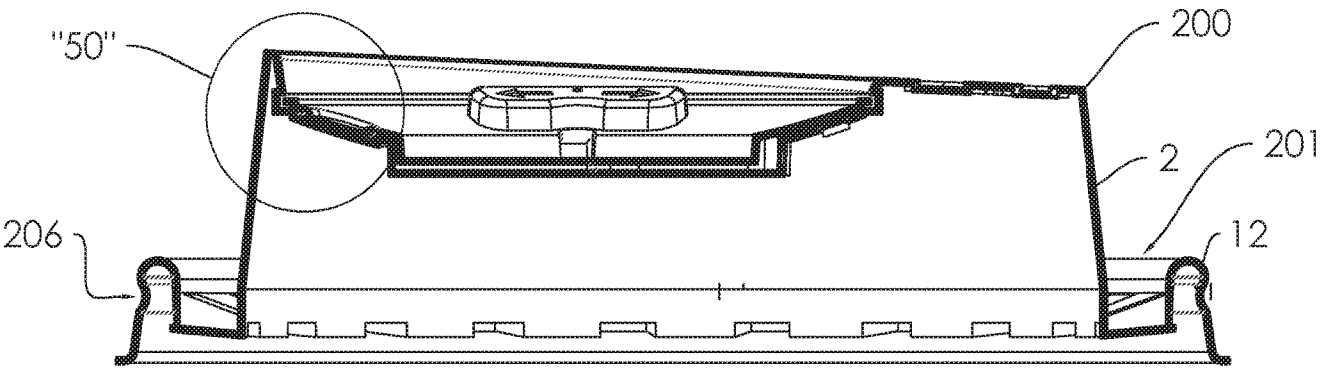
FIG. 49 is a longitudinal cross-sectional view as sectioned from FIG. 48 to show with greater clarity the structural relationship between the first alternative lid body or lower lid construction and disk body or upper lid construction.
Figure 48:
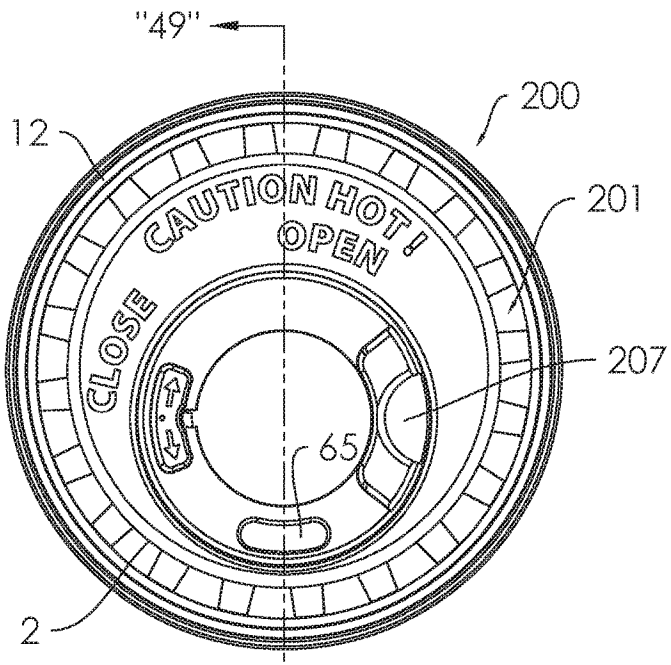
FIG. 48 is a top plan view of the first alternative lid construction according to the present invention comprising the lid body and disk body otherwise depicted in FIGS. 45 and 46 in assembled relation with one another and showing the ensemble in a closed lid configuration.
Figure 47:
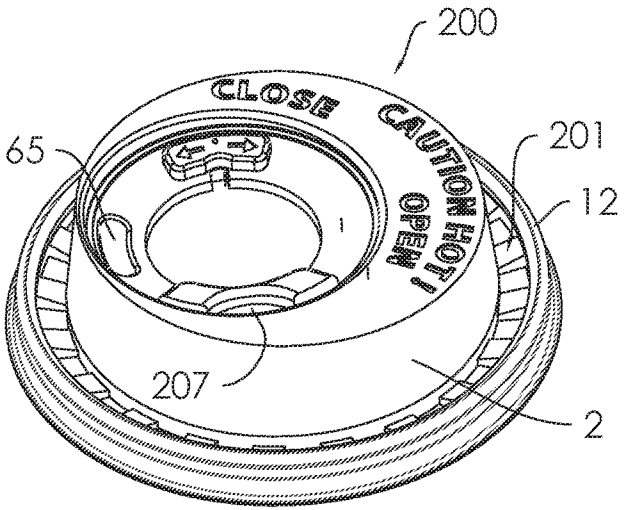
FIG. 47 is a top perspective view of the first alternative lid construction according to the present invention comprising the lid body and disk body otherwise depicted in FIGS. 45 and 46 in assembled relation with one another and showing the ensemble in a closed lid configuration.

Referencing FIGS. 45 and 46, the reader will there consider that the container lid 200 may preferably comprise a lower lid construction 60 and an upper lid construction 66. The upper lid construction 66 is seatable atop or receivable in the lower lid construction 60 and movable or rotatable relative thereto. The lower lid construction 60 preferably comprises a lower lid outlet as at 61 and the upper lid construction 66 preferably comprises an outlet-covering indentation as at 65 and an upper lid outlet as at 207. The outlet-covering indentation 65 is positionable over the lower lid outlet 61 for selectively preventing liquid egress therefrom. The main lid body or lower lid construction 60 thus receives the disk body or upper lid construction 66, which disk body 66 comprises an upper outer edge 67 and a lower outer edge 69. An elliptical part 40 of the disk body 66 and the indention 65 of the disk body 66 fit into the indention at the elliptical depression 43 in the main lid body 60. The elliptical depression 43 receives the elliptical part 40 of the disk body 66.

Figure 50:
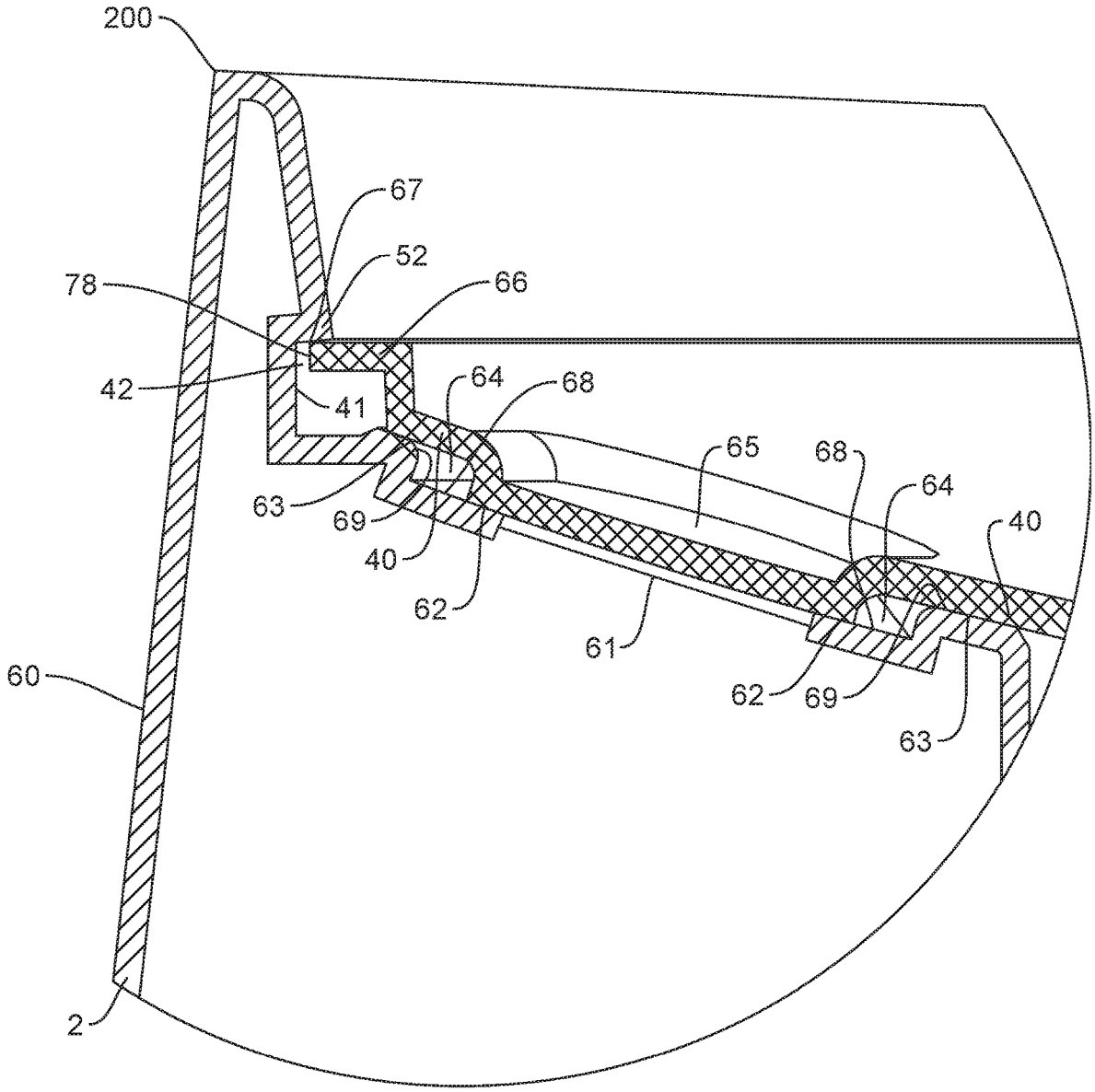
FIG. 50 is an enlarged, fragmentary sectional view as enlarged and sectioned from FIG. 49 to show in greater clarity the structures associated therewith.
Figure 51:
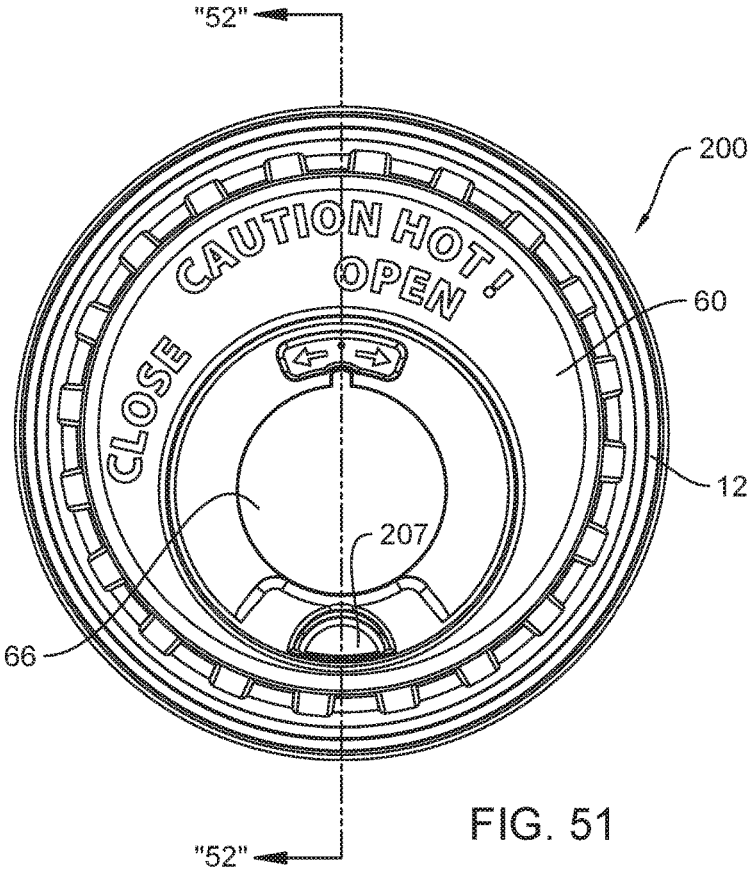
FIG. 51 is a top plan view of the first alternative lid construction according to the present invention showing the ensemble in an open lid configuration.
Figure 52:
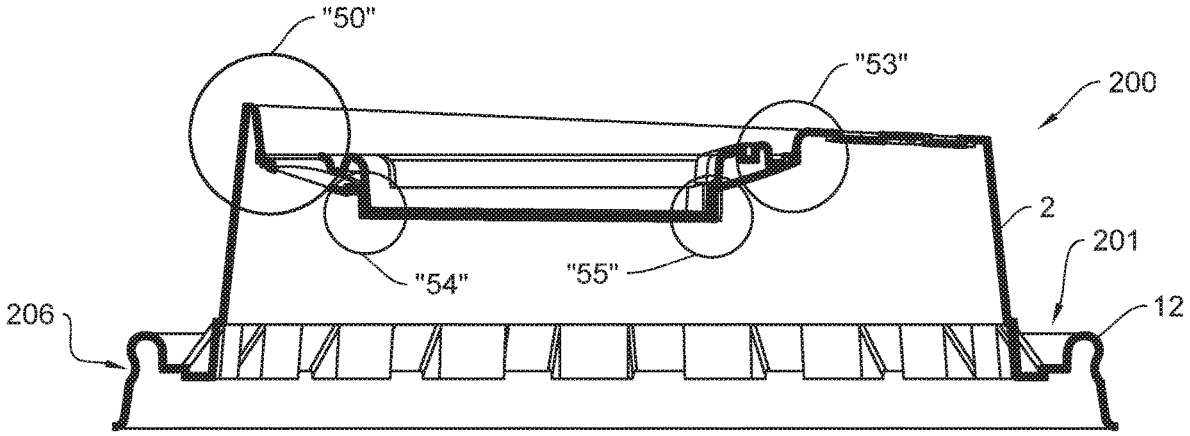
FIG. 52 is a longitudinal cross-sectional view as sectioned from FIG. 51 to show with greater clarity the structural relationship between the first alternative lid body or lower lid construction and disk body or upper lid construction.
Figure 53A:
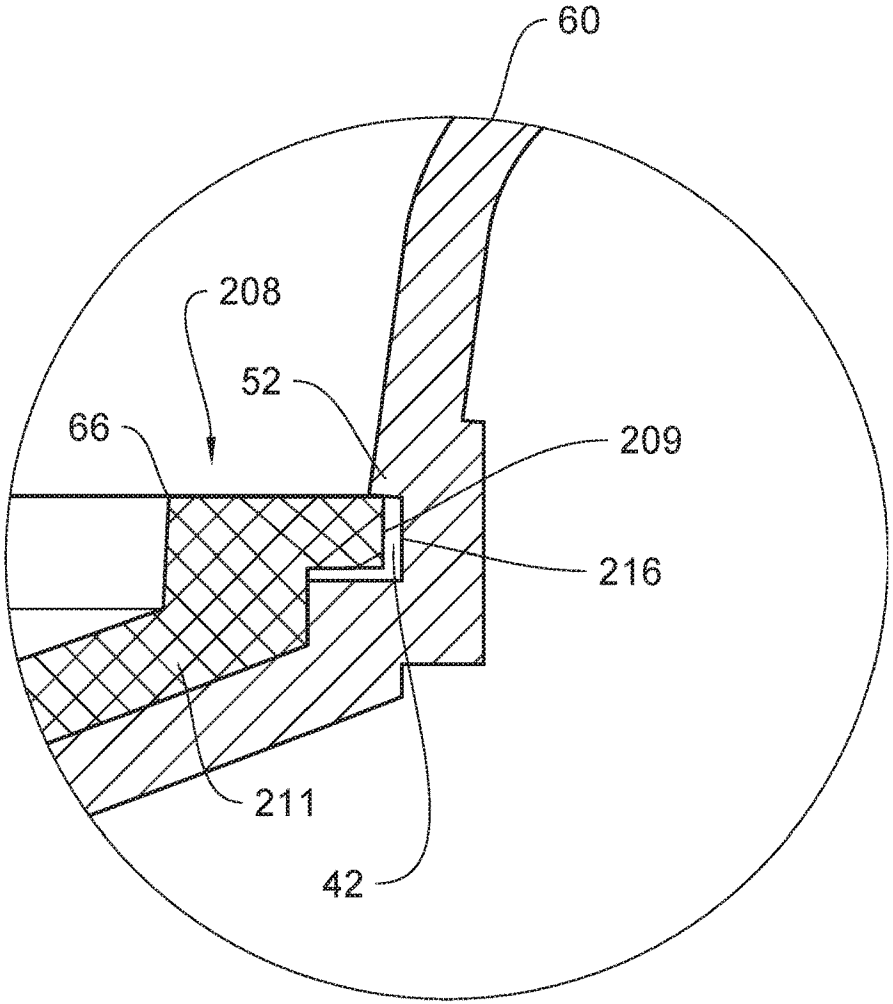
FIG. 53A is a further enlarged, fragmentary sectional view as enlarged and sectioned from FIG. 53 to show in greater clarity the structures associated therewith.
Figure 53:
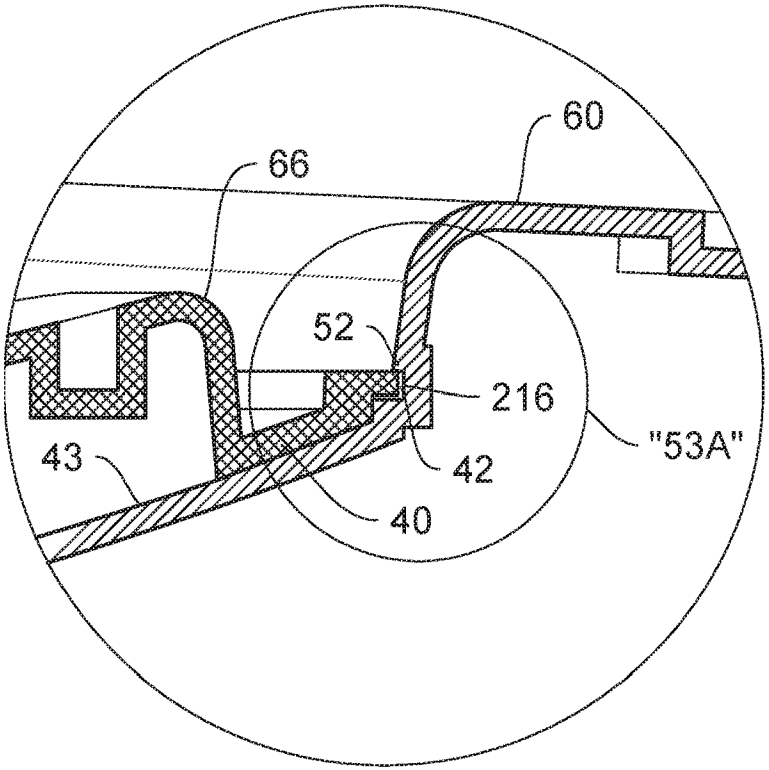
FIG. 53 is an enlarged, fragmentary sectional view as enlarged and sectioned from FIG. 52 to show in greater clarity the structures associated therewith.
Figure 56:
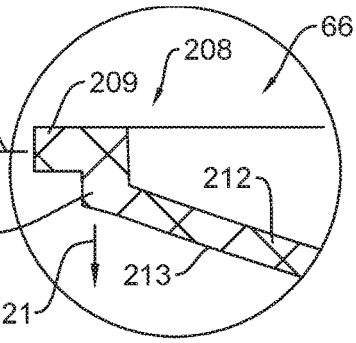
FIG. 56 is a fragmentary, enlarged sectional view of an edge portion of an upper lid construction according to the present invention to show in greater detail the edge portion.
Figure 57A:
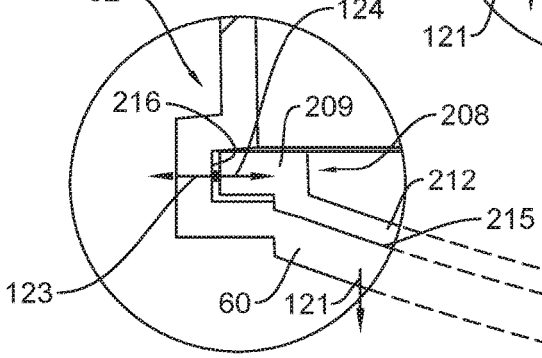
FIG. 57A is a fragmentary, enlarged sectional view of an edge portion of an upper lid construction engaged with an edge-receiving groove of a lower lid construction according to the present invention.
Figure 57B:
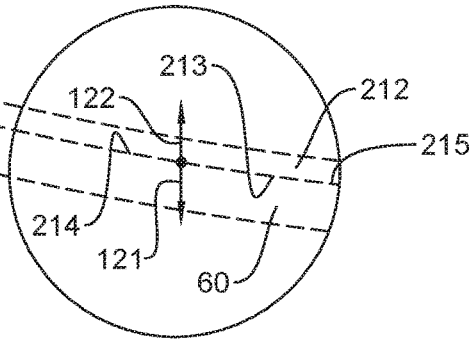
FIG. 57B is a fragmentary, enlarged sectional view of an interface between an upper lid construction and a lower lid construction according to the present invention.
Figure 54:
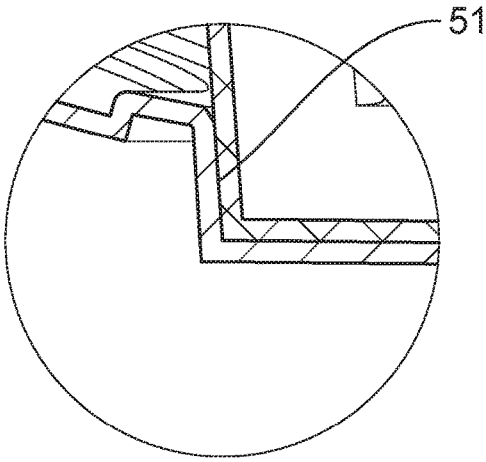
FIG. 54 is an enlarged, fragmentary sectional view as enlarged and sectioned from FIG. 52 to show in greater clarity the structures associated therewith.
Figure 55:
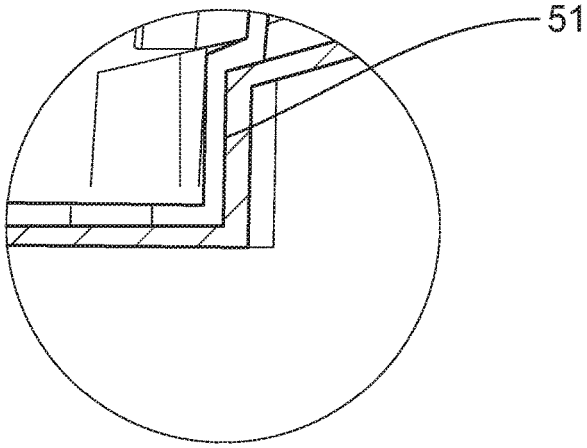
FIG. 55 is an enlarged, fragmentary sectional view as enlarged and sectioned from FIG. 52 to show in greater clarity the structures associated therewith.
Figure 59:
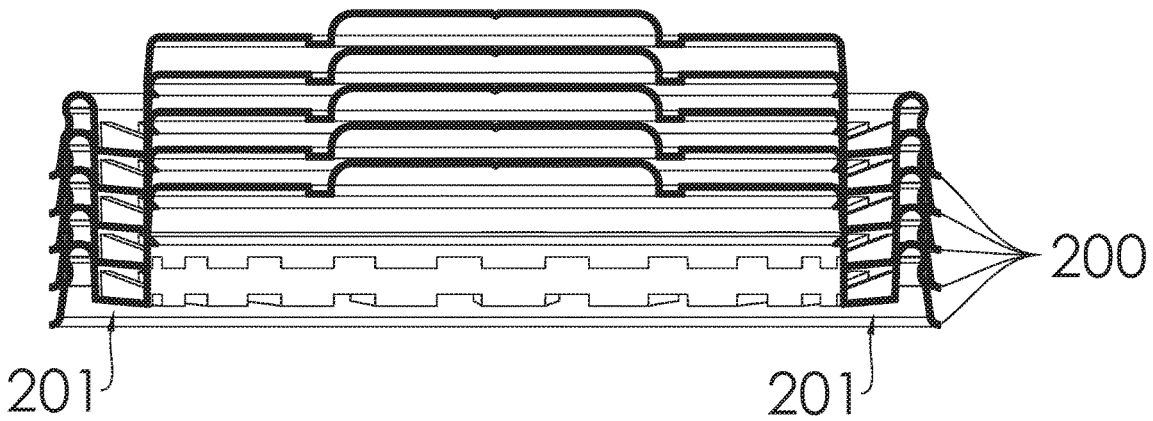
FIG. 59 is a first longitudinal cross-sectional view as sectioned from FIG. 58 to show in greater detail the series of stacked container lids according to the present invention, which container lids are each individually configured into an unlocked configuration for reduction in stacking height.
Figure 58:
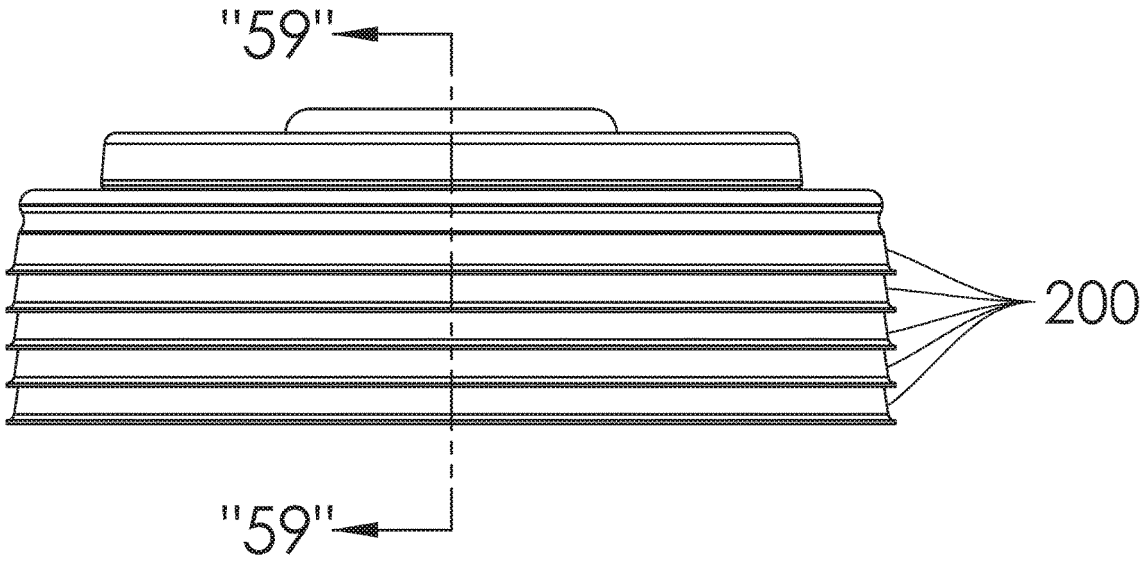
FIG. 58 is a side elevational view of a series of stacked container lids according to the present invention, which container lids are each individually configured into an unlocked configuration for reduction in stacking height.

Referencing FIG. 50, the reader will there consider the certain mechanical details relating to the substantially tight or snug engagement between the disk body or upper lid construction 66 and the undercut edge-receiving groove as at 52. The primary or main opening of the lower lid construction is referenced at 61. A tight or snug fit as at points 62 exists between the indention 65 on the disk body 66 and the indention 68 around the main opening 61 on the depressed part of the main lid body 60. A tight or snug fit as at points 63 is also placed between ridge 69 and structure adjacent indention 65 and the elliptical part of the disk body 66. Tightly fit planes as at 62 and 63 create air pocket(s) as at 64, which air pocket(s) 64 and tight engagements make it more difficult for liquid to egress therethrough.

The upper outer edge 67 of the disk body or upper lid construction 66 tightly fits against the upper side of the circular groove 52 at the same time there is some very small space 42 between outer edge 78 of the disk body 66 and the inner edge 41 of the groove 52. This arrangement limits friction between outer edge 78 of the disk body 66 and the inner edge 41 of the groove 52. The groove 52 functions as guide for the disk body 66 to hold the disk body 66 in place. The liquid seal is achieved mostly through the tight or snug fit between the elliptical part 40 of the disk body and the ridge 69 around the indention 68. Air pocket(s) 64 and indention 65 on the disk body 66 create additional liquid seals.

It will thus be understood that the primary lower lid outlet 61 is preferably formed within a lower lid indentation as at 68 and surrounded in spaced relation by a raised ridge as at 69. The outlet-covering indentation 65 of the upper lid construction 66 is preferably smaller in dimension than the lower lid indentation 68 (and larger in dimension than the lower lid outlet 61) such that a circumferential air pocket 64 extends between the lower lid indentation 68 and the outlet-covering indentation 65 when the outlet-covering indentation 65 covers the lower lid outlet 61. The circumferential air pocket 64, in combination with the tight or snug fit between adjoining structures, prevents liquid egress from the lower lid outlet 61.

Referencing fragmentary, enlarged FIGS. 53, 53A, 56, 57A, and 57B, the reader will there consider a so-called "step down formation" as at 208 of the upper lid construction 66 and associated features. The step down formation 208 is essentially L-shaped in vertically transverse cross-section and has an upper groove-engaging formation 209 extending in a first plane for insertion in edge-receiving groove 52, and a lower-spacing portion as at 211 extending in a second plane orthogonal to the first plane for spacing the lower portion 212 with lower surfacing 213 from the first plane of the groove-engaging formation 209.

The step down formation 208 effectively creates additional pressure between the lower surfacing 213 and the upper surfacing 214 of the lower lid construction 60 when the upper lid construction 66 is received in the insert-receiving formation 43. A downward force is referenced at 121 with a normal force 122 indicating the enhanced pressure effect at the surfacing interface as at arcuate line 215. At the same time, the step down formation 208 directs radially outwardly directed pressure or forces as at 123 with an opposing normal force 124 from the resilient return of the resiliently actuated upper lid construction 66 into the element-receiving groove 52 for enhancing periodic contact pressure between the upper lid construction 66 and the groove 52 at the edge-to-groove interface as at line 216. Thus, the interface 215 and the edge-to-groove interface 216 simultaneously provide leak proof sealing mechanisms orthogonally relative to one another as opposed to the DIXIE® brand "Smart Top Reclosable Hot Cup Lid".

It will thus be understood that the upper lid construction 66 further preferably comprises an edge-located step down formation as at 208, which step down formation 208 is received in an edge-receiving groove 52 formed in the lower lid construction 60. The step down formation 208 enhances seated engagement between the upper and lower lid constructions 66 and 60. The upper lid construction 66 is peripherally sized so as to form an air space 42, L-shaped in transverse cross-section, radially and outwardly adjacent the step down formation 208 when relaxed and received in the edge-receiving groove 52. The air space 42 reduces friction between the upper and lower lid constructions 66 and 60 when in a relaxed state.

Comparatively referencing FIG. 20 versus FIG. 21, and FIGS. 58 through 61A, the reader will note that the wall-to-groove locking mechanism or resilient portion 201 enables the user to either pre-engage or engage said mechanism at the time of packaging. The locking mechanism or all-to-groove resilient portion 201 according to the present invention may be reversibly placed into the engaged or locked configuration (closed container) by pushing down on the lid construction 200 or unengaged/unlocked position (open container) by pulling up on upper portions of the lid construction 200. The locked and unlocked configurations are reversible and can be repeated multiple times. When stacked lid constructions 200 are all placed into the locked configuration before being stacked the indentation-engaging portion(s) 9 minimize contact surface area between nested lids thereby reducing the tendency for nested lids to adhere to one another.

Figure 60:
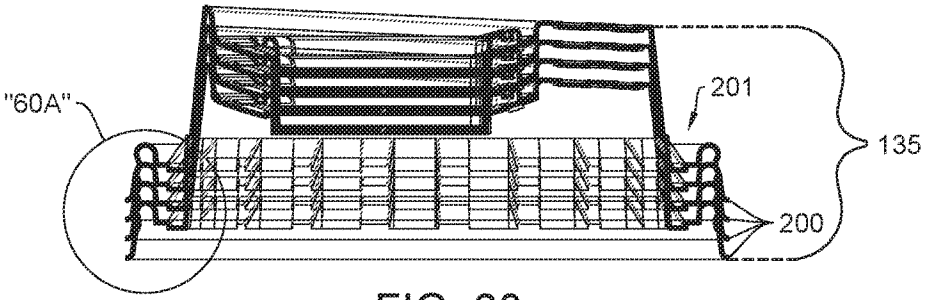
FIG. 60 is a second longitudinal cross-sectional view of a series of stacked container lids according to the present invention, which container lids are each individually configured into an unlocked configuration for reduction in stacking height.
Figure 61:
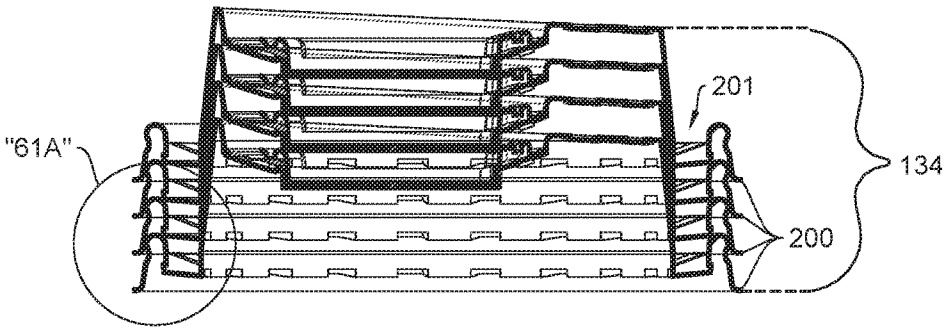
FIG. 61 is a longitudinal cross-sectional view of a series of stacked container lids according to the present invention, which container lids are each individually configured into a locked configuration for minimizing nested lid contact surface area thereby minimizing lid-to-lid adhesion for enabling ease with which successive container lids may be removed from the lid stack.
Figure 60A:
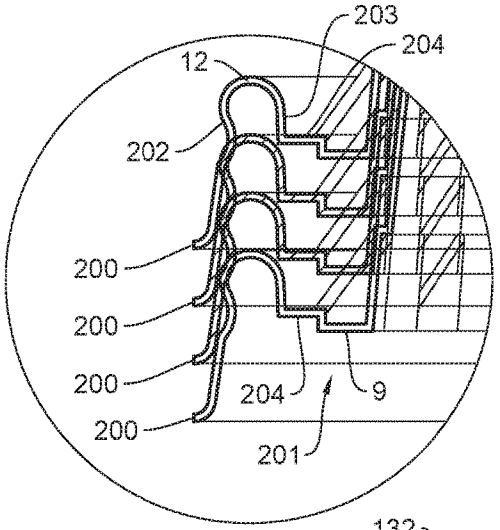
FIG. 60A is an enlarged, fragmentary sectional view as enlarged and sectioned from FIG. 60 to show in greater clarity the unlocked locking mechanisms according to the container lids there shown, the unlocked configurations for reducing stack height of the series of stacked container lids.
Figure 61A:
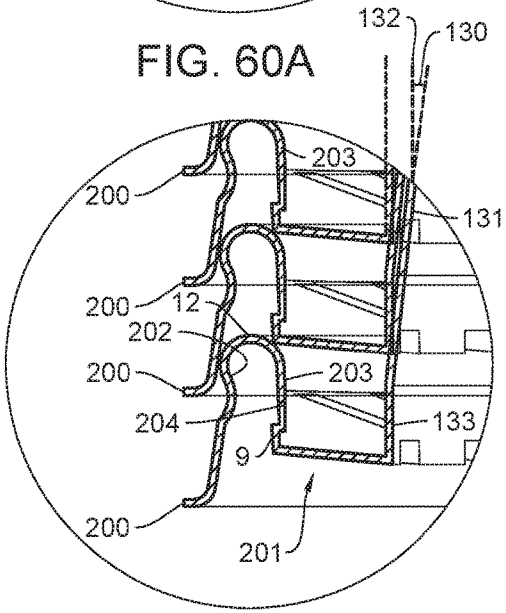
FIG. 61A is an enlarged, fragmentary sectional view as enlarged and sectioned from FIG. 61 to show in greater clarity the locked locking mechanisms according to the container lids there shown, the locked configurations for reducing lid-to-lid contact surface area and lid-to-lid adhesion.

The primary concept to be considered with reference to FIGS. 58 through 61A is the provision of a mechanism to prevent lid-to-lid adhesion or the sticking together of lids when packaged by placing the container lids into a locked or actuated configuration generally depicted in FIGS. 61 and 61A. When in the engaged configuration, the stacked lids will more easily dislodge or separate from one another. The engaged or locked configuration prevents the lids from mating to each other tightly, thus preventing sticking when packaged. The stacked lid height 134 when lids are stacked in the locked configuration as generally depicted in FIG. 61 is slightly greater than the stacked lid height 135 when lids 200 are stacked in the unlocked configuration as generally depicted in FIG. 60. The latter is preferred when reduction in stacked volume is of greater concern, and the former is preferred when ease of lid removal from the stacked arrangement is of greater concern.

In this regard, the reader will note that indentation-engaging portions 9 rest atop the rim-receiving groove 12 in superior adjacency to the inner groove wall 203 while simultaneously shifting pivot point 6 of an underlying container lid 200 upwardly to relatively higher portions 131 of the lid wall 2 which higher portions 131 extend in an angle 130 oblique to the plane 132 of relatively lower portions 133 of lid wall 2. This structural arrangement provides for reduced lid-to-lid contact surface area thereby reducing lid-to-lid adhesion for enabling greater ease when removing container lids 200 or 210 from the lid stack for deployment upon a liquid container as at 100 or 110.

Noting the unique structure of the containers 100 and 110, the present invention further contemplates a method of manufacturing the same. The manufacturing method according to the present invention is believed to preferably comprise the initial step of providing a cup fan as at 220. The cup fan 220 has a top edge 221, a bottom edge 222, opposed side edges as at 223, a first coated side as at 224, and a second non-coated side as at 225. The coated side 224 preferably comprises a hydrophobic material layer for preventing liquid permeation. A container sidewall or paper cone element 70 may then be formed from the cup fan 220 such that the container sidewall 70 has an open top end 227, an open bottom end 228, an inner cup surface 103, an outer cup surface 104, and a longitudinal seam 30 extending from the open top end 227 to the open bottom end 228 at an overlap site 229 of the opposed side edges 223.

A heated first press element 72 may then be positioned adjacent the outer cup surface 104. The first press element 72 has a non-planar first press surface as exemplified by a female indentation as at 73. A second press element 71 or cone mold is further positioned adjacent the inner cup surface 103, which second press element 71 also has a non-planar second press surface as exemplified by a male protuberance as at 74. The first and second press surfaces are thus matable. The outer and inner cup surfaces 104 and 103 are thus pressed between the first and second press elements 72 and 71 such that the first and second press surfaces 73 and 74 form at least one non-planar singular formation exemplified by primary indentation 31 at the inner surface 103 with a corresponding raised ridge or protuberance formation 105 at the outer cup surface 104 collectively referred to as the primary indentation formation 31.

The second side 225 may preferably be processed before forming the container sidewall or paper cone element 70 so as to remove material therefrom adjacent a first of the opposed side edges 223 thereby forming at least one material-removed edge section as at 33. The material-removed edge section 33 preferably extends obliquely relative to the planar first side 224 for reducing a seam thickness at the inner cup surface 103 as generally and comparatively depicted in FIG. 36A versus FIG. 37A. Comparatively referencing FIG. 30 versus FIG. 29, it will be seen that the material-removed edge section 33 may be located adjacent the top edge 221 or may extend an entire length of the first of the opposed side edges 223 intermediate the top edge 221 and bottom edge 222.

Noting that the first press element 72 preferably comprises a female indentation 73 and the second press element 71 preferably comprises a male protuberance 74, the male protuberance 74 is matable with the female indentation 73 via the material construction of the cup fan 220 for forming an outwardly extending indentation 31 at the inner cup surface 103 with corresponding protuberance 105 at the outer cup surface 104. The method may be further defined by positioning the first and second press elements 72 and 71 such that the first and second press elements 72 and 71 are positioned adjacent the seam 30 for forming the non-planar formation exemplified by the primary indentation 31 at or in traversal relative to the seam 30. In other words, the non-planar formation is preferably formed in such a way as to orthogonally traverse the seam 30 with equal portions of the indentation 31 extending across the seam 30 at the inner cup surface 103 and further being of a sufficient length to traverse the seam 30 at the outer cup surface 104.

Figure 15:
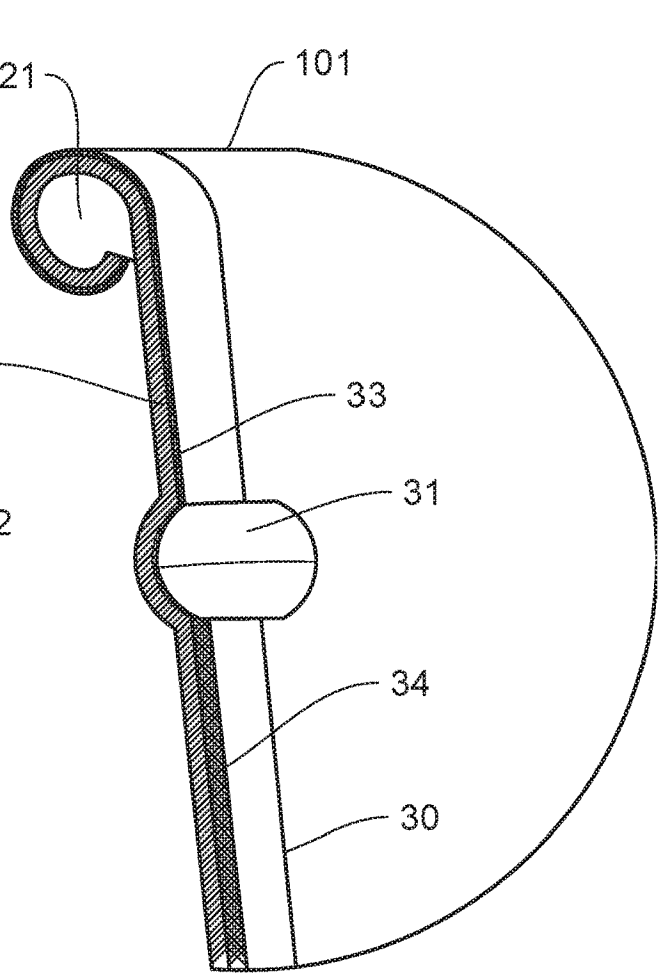
FIG. 15 is an enlarged, fragmentary section view as sectioned from FIG. 14 to show in greater detail the structures associated with the seam and indentation formation sites.
Figure 14:
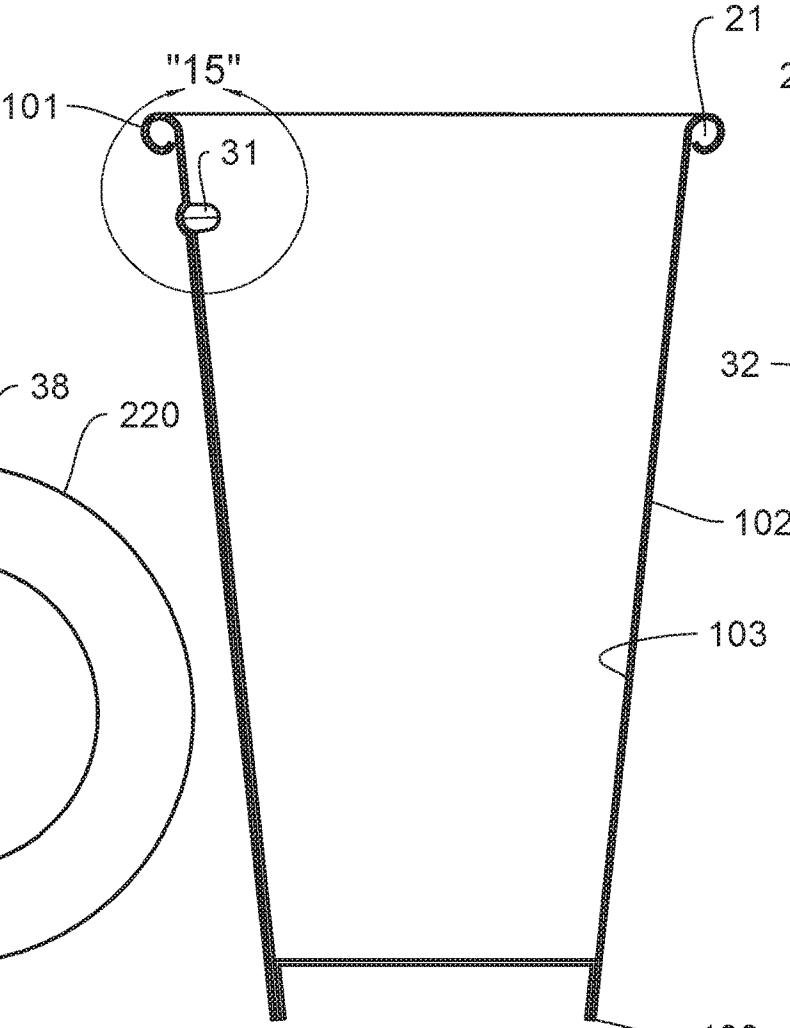
FIG. 14 is a longitudinal cross-sectional of a seamed paper cup container through the seam site to show a partial indentation formation site across the seam site.
Figure 28:
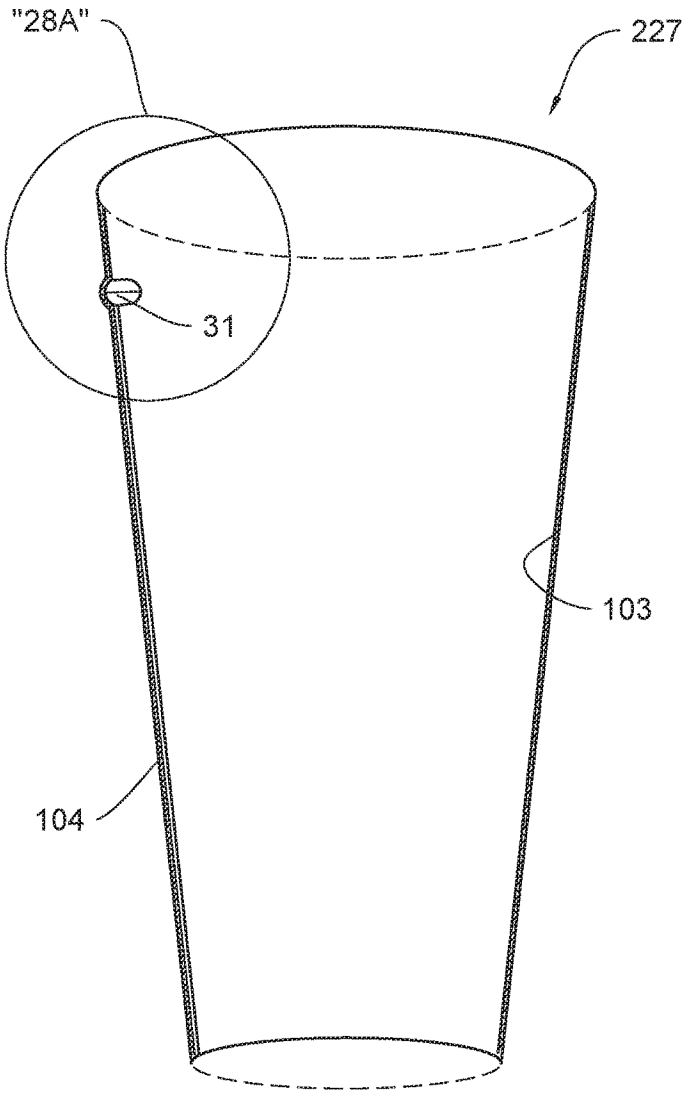
FIG. 28 is a cross-sectional perspective depiction of the seamed container sidewall outfitted with an indentation formation, the cross-section being sectioned through the seam junction.
Figure 28A:
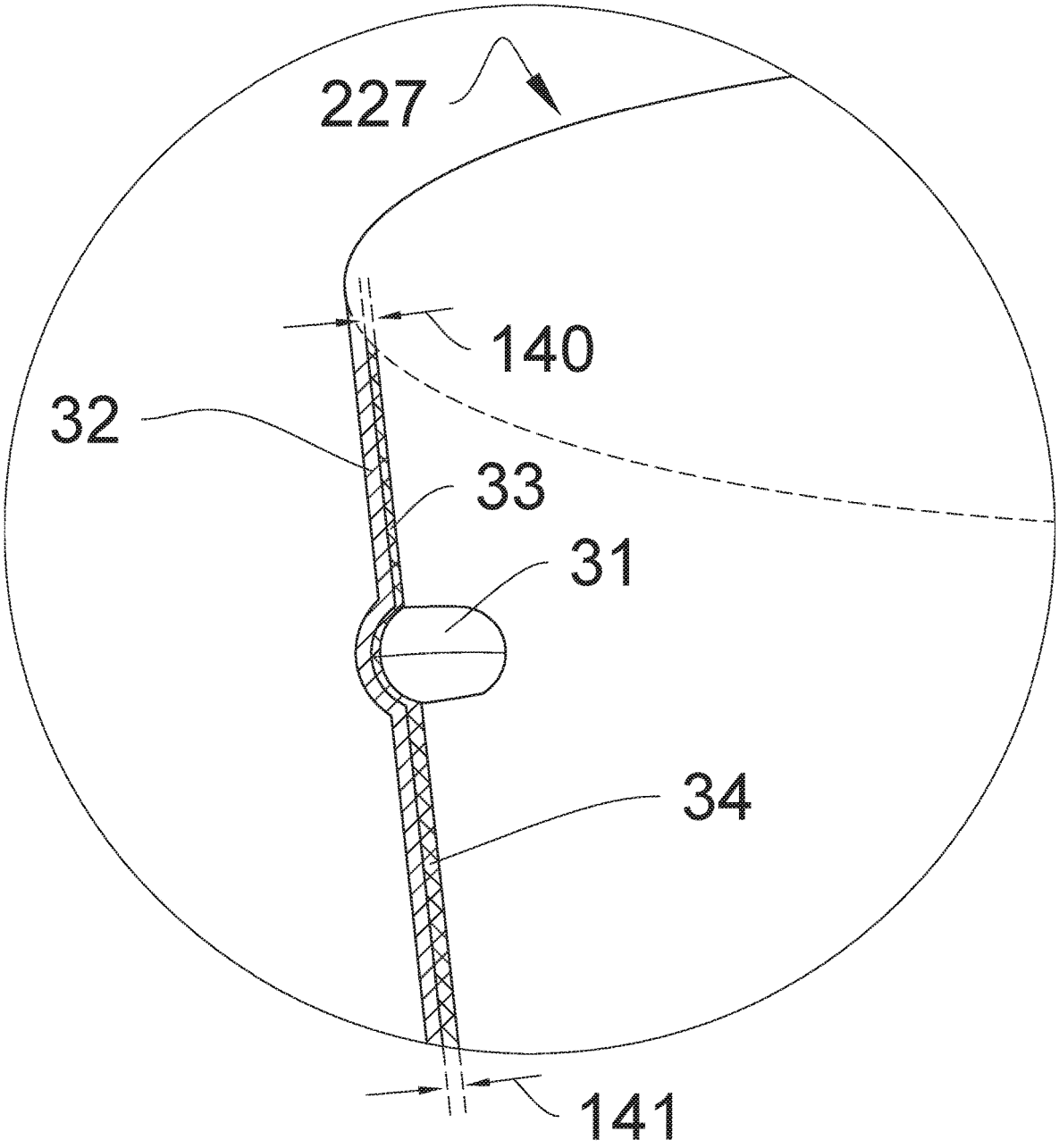
FIG. 28A is an enlarged, fragmentary sectional view as sectioned from FIG. 28 to show in greater detail the structures associated therewith, the material thickness above the indentation formation being lesser than the material thickness below the indentation formation.

Comparatively referencing FIGS. 24-37, and FIG. 26A in particular, it will be seen that level or plane 75 is parallel and higher than level or plane 76 on the metal cone-mold 71 to exert additional pressure at the point where the edge of the paper is shaved/sanded/pressed as depicted in FIGS. 30 and 32 at reference numeral 33 or as further depicted in FIG. 28A and FIG. 15. This method could also be used to press this paper edge under high pressure to "squeeze" it to minimal thickness as at 33. This type of pressing could require significant increase in power of the press for the heating element, but thinning the edge by this method does provide excellent results.

As a result of edge modification, the desired result of minimizing the "step" thickness at the paper seam joint 30 at the inner container surface 103 as shown in FIGS. 15 and 28A may be achieved in different ways. An additional benefit of thinning the back or non-coated edge of the cup fan 220 is that the material removal also makes it easier to curl the top edge of the container sidewall 70 in later steps and further creates smoother roll to more tightly accommodate the rim-receiving groove 12 of the container lid 200.

While the above descriptions contain much specificity, this specificity should not be construed as limitations on the scope of the invention, but rather as an exemplification of the invention. In certain alternative embodiments, the basic invention may be said to essentially teach or disclose a container lid for maximizing lid-to-container retention or for preventing inadvertent removal of the container lid from a liquid container. The container lids according to the present invention may be said to essentially comprise or include a rim-receiving groove, a lid wall, and a resilient portion extending intermediate the rim-receiving groove and the lid wall.

The resilient portion is resiliently actuable intermediate an unlocked configuration and a locked configuration, and further preferably comprises at least one indentation-engaging portion. The rim-receiving groove receives the upper container rim, and the at least one indentation-engaging portion engages the at least one indentation when in the locked configuration. Together, the rim-receiving groove and the at least one indentation-engaging portion lock the container lid to the upper container rim of a liquid container when in the locked configuration for maximizing lid-to-container retention.

Referencing FIGS. 58-61A, the reader will recall the container lids according to the present invention are stackable in a series of identical container lids. The series of identical container lids have a relatively reduced stacked height when in the unlocked configuration as compared to the locked configuration and further have a reduced lid-to-lid contact surface area when in the locked configuration for reducing lid-to-lid adhesion. The user may thus select either the unlocked or locked configurations when packaging container lids according to the present invention depending on the requirements of the user. The stackable container lid thereby provides users with packaging options.

The container lids according to the present invention are further usable in combination with a particularly manufactured liquid container according to the present invention. The liquid container preferably comprises or includes an upper container rim and a container wall extending downwardly from the upper container rim. The container wall comprises a seam and at least one indentation at the inner container surface. The seam extends orthogonally relative to the container rim, and the at least one indentation extends outwardly at the inner container surface of the container wall.

Figure 13:
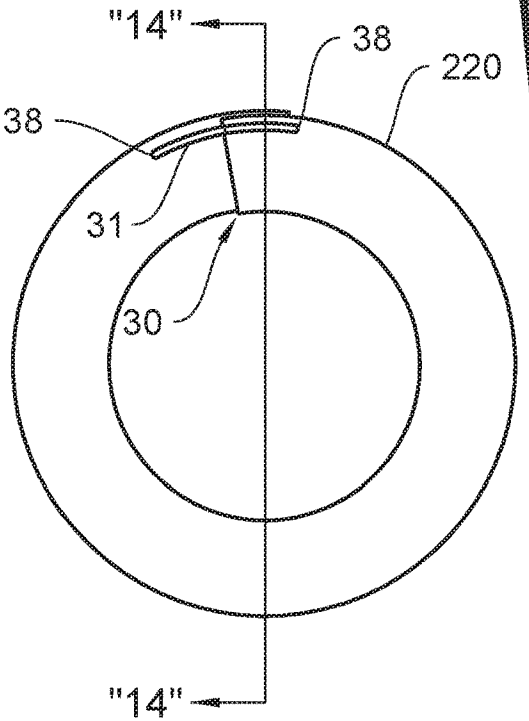
FIG. 13 is a top plan type diagrammatic depiction of a seamed paper cup container depicting a relatively enlarged indentation formation traversing the seam such that the indentation formation is bisected at its middle point at the inner container surface, the indentation formation being of sufficient length to also traverse the seam at the outer container surface.
Figure 17:
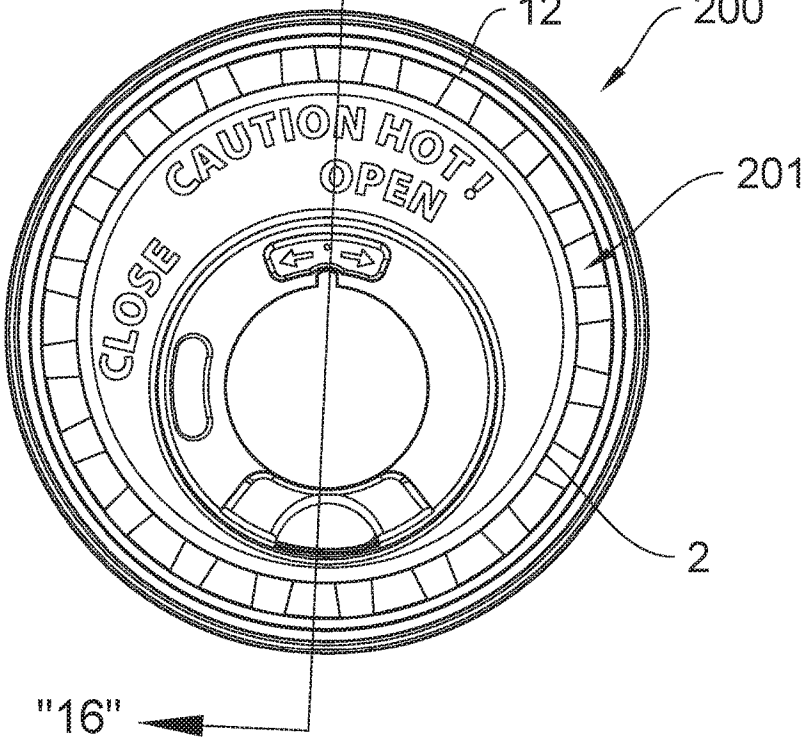
FIG. 17 is a top plan view of the lid construction otherwise depicted in FIG. 16 as outfitted upon the seamed paper cup container.
Figure 16:
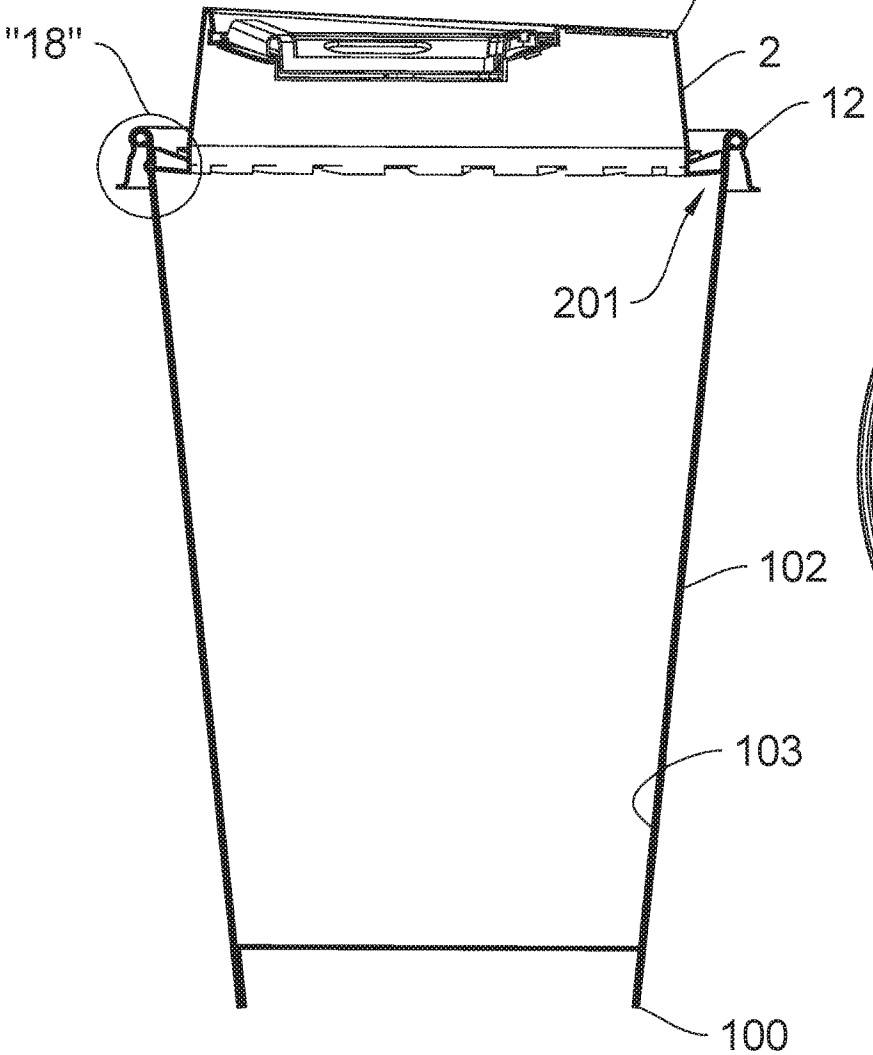
FIG. 16 is a longitudinal cross-sectional view of seamed paper cup container outfitted with a lid construction according to the present invention as sectioned through the seam site.

The at least one indentation comprises a primary indentation, the primary indentation preferably traverses the seam in parallel relation to the container rim. The primary indentation traverses the seam at the inner container surface such that the seam at the inner container surface bisects the primary indentation in substantially equal half portions 38 as generally depicted in FIG. 13. The container wall may further preferably comprise a series of secondary indentations that extend outwardly in inferior adjacency to the upper container rim at the inner surface of the container wall in parallel relation to the container rim and in coplanar relation with the primary indentation. This feature is basically seen in liquid container 110.

The rim-receiving groove of the container lids preferably comprises an outer groove wall and an inner groove wall. The wall-to-groove resilient portion as at 201 is preferably L-shaped and connected to the inner groove wall at a first pivot point. The L-shaped resilient portion comprises a base portion and an upright portion that pivot between the unlocked and locked positions. The base portion extends inwardly from the inner groove wall and the upright portion extends substantially parallel to the inner groove wall when in the unlocked configuration. When in the locked configuration, the base portion is coplanar with the inner groove wall and the upright portion extends inwardly relative to the inner groove wall.

The lid wall may preferably comprise a lid indentation as at feature 4. The lid indentation extends inwardly in superior adjacency to the wall-to-groove resilient portion. The lid indentation is connected to the upright portion at a second pivot point, and provides a resilient structural relief for enhancing movement between the locked and unlocked configuration. The outer groove wall of the rim-receiving groove preferably comprises a groove wall indentation. The groove wall indentation extends inwardly in inferior adjacency to the upper container rim for enhancing fitted engagement therewith.

The container lid is preferably provided as an ensemble comprising a lower lid construction and an upper lid construction. The upper lid construction is seatable atop the lower lid construction and is movable relative thereto. The lower lid construction comprises a lower lid outlet and the upper lid construction comprises an outlet-covering indentation and an upper lid outlet. The outlet-covering indentation is positionable over the lower lid outlet for selectively preventing liquid egress therefrom.

The lower lid outlet is formed in a lower lid indentation and surrounded in spaced relation by a raised ridge. The outlet-covering indentation is smaller in dimension than the lower lid indentation such that an air pocket extends between the lower lid indentation and the outlet-covering indentation when the outlet-covering indentation covers the lower lid outlet. The air pocket further prevents liquid egress from the lower lid outlet.

The upper lid construction comprises an edge-located step down formation received in an edge-receiving groove formed in the lower lid construction. The step down formation enhances seated engagement between the upper and lower lid constructions. The upper lid construction is peripherally sized so as to form an air space radially and outwardly adjacent the step down formation when received in the edge-receiving groove. The air space reduces friction between the upper and lower lid constructions.

The present invention further contemplates a method of manufacturing a liquid container comprising the steps of providing a cup fan, the cup fan having a top edge, a bottom edge, and opposed side edges, and forming a container sidewall from the cup fan. The container sidewall has an open top end, an open bottom end, an inner cup surface, and outer cup surface, and a longitudinal seam extending from the open top end to the open bottom end at an overlap site of the opposed side edges.

First and second press elements are positioned adjacent the outer and inner cup surfaces, preferably at the seam site. Each of the first and second press elements have a non-planar press surface, which surfaces are matable. The outer and inner cup surfaces are pressed via or between the first and second press elements for forming at least one non-planar singular formation at the inner and outer cup surfaces traversing the seam site. The first press element may preferably comprises a female indentation and the second press element may preferably comprise a male protuberance. The male protuberance is matable with the female indentation for forming an outwardly extending indentation at the inner cup surface.

The cup fan preferably comprises a first side and a second side. The second side may preferably be processed before forming the container sidewall to remove material therefrom adjacent a first of the opposed side edges thereby forming at least one material-removed edge section. The material-removed edge section preferably extends obliquely relative to the first side for reducing a seam thickness at the inner cup surface. The material-removed edge section may extend an entire length of the first of the opposed side edges or may be formed adjacent the top edge.

Accordingly, although the inventive lid-container combinations or assemblies according to the present invention have been described by reference to a number of different embodiments, it is not intended that the novel combinations or assemblies be limited thereby, but that modifications thereof are intended to be included as falling within the broad scope and spirit of the foregoing disclosure, the appended drawings, and perhaps most importantly, the following claims.

I claim:

1. A container assembly for maximizing lid-to-container retention, the container assembly comprising:

a container, the container comprising a container rim and a container wall extending downwardly from the container rim, the container wall comprising a seam and a primary indentation, the seam extending orthogonally relative to the container rim, the primary indentation extending outwardly in inferior adjacency to the container rim at an inner surface of the container wall, the primary indentation traversing the seam in parallel relation to the container rim; and a container lid, the container lid comprising a rim-receiving groove, a lid wall, and an L-shaped resilient portion, the rim-receiving groove comprising an outer groove wall and an inner groove wall, the L-shaped resilient portion being connected to the inner groove wall at a first pivot point, the L-shaped resilient portion extending intermediate the lid wall and the rim-receiving groove and being resiliently actuable intermediate an unlocked configuration and a locked configuration;

the L-shaped resilient portion comprising a base portion and an upright portion, the base portion extending inwardly from the inner groove wall and the upright portion extending substantially parallel to the inner groove wall when in the unlocked configuration, the base portion being coplanar with the inner groove wall and the upright portion extending inwardly relative to the inner groove wall when in the locked configuration;

the L-shaped resilient portion further comprising at least one indentation-engaging portion, the rim-receiving groove for receiving the container rim, the at least one indentation-engaging portion being engageable with the primary indentation when in the locked configuration, the rim-receiving groove and the at least one indentation-engaging portion together for locking the container lid to the container when in the locked configuration for cooperatively maximizing lid-to-container retention.

2. The container assembly of claim 1 wherein the primary indentation traverses the seam at the inner container surface such that the seam at the inner container surface bisects the primary indentation in substantially equal half portions.

3. The container assembly of claim 1 wherein the container wall comprises a series of secondary indentations, the series of secondary indentations extending in inferior adjacency to the container rim at the inner surface of the container wall in parallel relation to the container rim and in coplanar relation with the primary indentation.

4. The container assembly of claim 1 wherein the lid wall comprises a lid indentation, the lid indentation extending inwardly in superior adjacency to the resilient portion, the lid indentation being connected to the upright portion at a second pivot point, the lid indentation providing a resilient structural relief for enhancing movement between the locked and unlocked configurations.

5. The container assembly of claim 1 wherein the outer groove wall comprises a groove wall indentation, the groove wall indentation extending inwardly in inferior adjacency to the container rim for enhancing fitted engagement therewith.

6. The container assembly of claim 1 wherein the container lid comprises a lower lid construction and an upper lid construction, the upper lid construction being seatable atop the lower lid construction and being movable relative thereto, the lower lid construction comprising a lower lid outlet and the upper lid construction comprises an outlet-covering indentation and an upper lid outlet, the outlet-covering indentation being positionable over the lower lid outlet for selectively preventing liquid egress therefrom.

7. The container assembly of claim 6 wherein the lower lid outlet is formed in a lower lid indentation and surrounded in spaced relation by a raised ridge, the outlet-covering indentation being smaller in dimension than the lower lid indentation such that an air pocket extends between the lower lid indentation and the outlet-covering indentation when the outlet-covering indentation covers the lower lid outlet, the air pocket for further preventing liquid egress from the lower lid outlet.

8. The container assembly of claim 6 wherein the upper lid construction comprises an edge-located step down formation, the step down formation being received in an edge-receiving groove formed in the lower lid construction, the step down formation for enhancing seated engagement between the upper and lower lid constructions.

9. The container assembly of claim 8 wherein the upper lid construction is peripherally sized so as to form an air space radially and outwardly adjacent the step down formation when received in the edge-receiving groove, the air space for reducing friction between the upper and lower lid constructions.

10. The container assembly of claim 1 wherein the locked configuration of the container lid comprises a reduced internal volume relative to the unlocked configuration of the container lid when the container lid is attached to the container.

11. A container lid for maximizing lid-to-container retention, the container lid comprising:

a rim-receiving groove, a lid wall, and an L-shaped resilient portion extending intermediate the rim-receiving groove and the lid wall, the rim-receiving groove comprising an outer groove wall and an inner groove wall, the L-shaped resilient portion being resiliently actuable intermediate an unlocked configuration and a locked configuration;

the L-shaped resilient portion comprising a base portion and an upright portion, the base portion extending inwardly from the inner groove wall and the upright portion extending substantially parallel to the inner groove wall when in the unlocked configuration, the base portion being coplanar with the inner groove wall and the upright portion extending inwardly relative to the inner groove wall when in the locked configuration;

the resilient portion comprising at least one indentation-engaging portion, the rim-receiving groove for receiving a container rim of a container, the at least one indentation-engaging portion being engageable with the container wall when in the locked configuration, the rim-receiving groove and the at least one indentation-engaging portion together for locking the container lid to the container when in the locked configuration for maximizing lid-to-container retention.

12. The container lid of claim 11 being stackable with a series of identical container lids, the series of identical container lids having a relatively reduced stacked height when in the unlocked configuration as compared to the locked configuration, and having reduced lid-to-lid contact surface area when in the locked configuration for reducing lid-to-lid adhesion, the stackable container lid thereby providing a user with packaging options.

13. The container lid of claim 11 usable in combination with the container, the container wall comprising a seam and at least one indentation, the seam extending orthogonally relative to the container rim, the at least one indentation extending outwardly at an inner surface of the container wall, the at least one indentation-engaging portion being engageable with the at least one indentation when in the locked configuration.

14. The container lid of claim 13 wherein the at least one indentation comprises a primary indentation, the primary indentation traversing the seam in parallel relation to the container rim.

15. The container lid of claim 11 being stackable with a series of identical container lids, the series of identical container lids having a relatively reduced stacked volume when in the unlocked configuration as compared to the locked configuration.

* * * * *